US010480516B2

(12) United States Patent
Stiles, Jr. et al.

(10) Patent No.: US 10,480,516 B2
(45) **Date of Patent: *Nov. 19, 2019**

(54) ANTI-ENTRAPMENT AND ANTI-DEADHEAD FUNCTION

(71) Applicants: Pentair Water Pool and Spa, Inc., Cary, NC (US); Danfoss Power Electronics A/S, Graasten (DK)

(72) Inventors: Robert W. Stiles, Jr., Cary, NC (US); Lars Hoffmann Berthelsen, Kolding (DK); Peter Westermann-Rasmussen, Soenderborg (DK); Gert Kjaer, Soenderborg (DK); Florin Lungeanu, Egersund (DK)

(73) Assignees: Pentair Water Pool and Spa, Inc., Cary, NC (US); Danfoss Power Electrics A/S, Graasten (DK)

( * ) Notice: Subject to any disclaimer, the term of this patent is extended or adjusted under 35 U.S.C. 154(b) by 209 days.

This patent is subject to a terminal disclaimer.

(21) Appl. No.: 15/386,993

(22) Filed: Dec. 21, 2016

(65) Prior Publication Data

US 2017/0114788 A1 Apr. 27, 2017

Related U.S. Application Data

(63) Continuation of application No. 14/097,101, filed on Dec. 4, 2013, now Pat. No. 9,551,344, which is a (Continued)

(51) Int. Cl.

| | |
|---|---|
| ***F04D 15/00*** | (2006.01) |
| ***F04B 49/20*** | (2006.01) |
| ***F04D 13/06*** | (2006.01) |

(52) U.S. Cl.

CPC ..... *F04D 15/0077* (2013.01); *F04B 49/20* (2013.01); *F04D 13/06* (2013.01); *F04D 15/0066* (2013.01); *F04D 15/0088* (2013.01)

(58) Field of Classification Search

CPC ..... F04B 49/06; F04B 49/10; F04B 49/20; F04D 15/0066; F04D 15/0077; E04H 4/12; E04H 4/1245

See application file for complete search history.

(56) References Cited

U.S. PATENT DOCUMENTS

| | | | |
|---|---|---|---|
| 981,213 | A | 1/1911 | Mollitor |
| 1,993,267 | A | 3/1935 | Ferguson |

(Continued)

FOREIGN PATENT DOCUMENTS

| | | | |
|---|---|---|---|
| AU | 3940997 | | 2/1998 |
| AU | 2005204246 | A1 | 3/2006 |

(Continued)

OTHER PUBLICATIONS

Allen-Bradley; "1336 Plus II Adjustable Frequency AC Drive with Sensorless Vector User Manual;" Sep. 2005; pp. 1-212.

(Continued)

*Primary Examiner* — Patrick Hamo

(74) *Attorney, Agent, or Firm* — Quarles & Brady LLP

(57) ABSTRACT

In accordance with one aspect, the present disclosure provides for systems and methods for controlling a pumping system for at least one aquatic application. The pumping system can include a pump, a motor coupled to the pump, an interface associated with the pump designed to receive input instructions from a user, and a controller in communication with the motor. The controller determines a blockage condition based on a power consumption value of the motor, and can further include an auto-restart function that is designed to allow the pump to automatically restart after detection of the blockage.

27 Claims, 7 Drawing Sheets

Related U.S. Application Data continuation of application No. 11/609,057, filed on Dec. 11, 2006, now Pat. No. 8,602,745, which is a continuation-in-part of application No. 10/926,513, filed on Aug. 26, 2004, now Pat. No. 7,874,808, which is a continuation-in-part of application No. 11/286,888, filed on Nov. 23, 2005, now Pat. No. 8,019,479.

(56) References Cited

U.S. PATENT DOCUMENTS

| | | | |
|---|---|---|---|
| 2,238,597 | A | 4/1941 | Page |
| 2,458,006 | A | 1/1949 | Kilgore |
| 2,488,365 | A | 11/1949 | Abbott et al. |
| 2,494,200 | A | 1/1950 | Ramqvist |
| 2,615,937 | A | 10/1952 | Ludwig |
| 2,716,195 | A | 8/1955 | Anderson |
| 2,767,277 | A | 10/1956 | Wirth |
| 2,778,958 | A | 1/1957 | Hamm et al. |
| 2,881,337 | A | 4/1959 | Wall |
| 3,116,445 | A | 12/1963 | Wright |
| 3,191,935 | A | 6/1965 | Uecker |
| 3,204,423 | A | 10/1965 | Resh, Jr. |
| 3,213,304 | A | 10/1965 | Landerg et al. |
| 3,226,620 | A | 12/1965 | Elliott et al. |
| 3,227,808 | A | 1/1966 | Morris |
| 3,291,058 | A | 12/1966 | McFarlin |
| 3,316,843 | A | 5/1967 | Vaughan |
| 3,481,973 | A | 12/1969 | Wygant |
| 3,530,348 | A | 9/1970 | Connor |
| 3,558,910 | A | 1/1971 | Dale et al. |
| 3,559,731 | A | 2/1971 | Stafford |
| 3,562,614 | A | 2/1971 | Gramkow |
| 3,566,225 | A | 2/1971 | Paulson |
| 3,573,579 | A | 4/1971 | Lewus |
| 3,581,895 | A | 6/1971 | Howard et al. |
| 3,593,081 | A | 7/1971 | Forst |
| 3,594,623 | A | 7/1971 | LaMaster |
| 3,596,158 | A | 7/1971 | Watrous |
| 3,613,805 | A | 10/1971 | Lindstad |
| 3,624,470 | A | 11/1971 | Johnson |
| 3,634,842 | A | 1/1972 | Niedermeyer |
| 3,652,912 | A | 3/1972 | Bordonaro |
| 3,671,830 | A | 6/1972 | Kruger |
| 3,726,606 | A | 4/1973 | Peters |
| 1,061,919 | A | 5/1973 | Miller |
| 3,735,233 | A | 5/1973 | Ringle |
| 3,737,749 | A | 6/1973 | Schmit |
| 3,753,072 | A | 8/1973 | Jurgens |
| 3,761,750 | A | 9/1973 | Green |
| 3,761,792 | A | 9/1973 | Whitney |
| 3,777,232 | A | 12/1973 | Woods et al. |
| 3,777,804 | A | 12/1973 | McCoy |
| 3,778,804 | A | 12/1973 | Adair |
| 3,780,759 | A | 12/1973 | Yahle et al. |
| 3,781,925 | A | 1/1974 | Curtis |
| 3,787,882 | A | 1/1974 | Fillmore |
| 3,792,324 | A | 2/1974 | Suarez |
| 3,800,205 | A | 3/1974 | Zalar |
| 3,814,544 | A | 6/1974 | Roberts et al. |
| 3,838,597 | A | 10/1974 | Montgomery et al. |
| 3,867,071 | A | 2/1975 | Hartley |
| 3,882,364 | A | 5/1975 | Wright |
| 3,902,369 | A | 9/1975 | Metz |
| 3,910,725 | A | 10/1975 | Rule |
| 3,913,342 | A | 10/1975 | Barry |
| 3,916,274 | A | 10/1975 | Lewus |
| 3,941,507 | A | 3/1976 | Niedermeyer |
| 3,949,782 | A | 4/1976 | Athey et al. |
| 3,953,777 | A | 4/1976 | McKee |
| 3,956,760 | A | 5/1976 | Edwards |
| 3,963,375 | A | 6/1976 | Curtis |
| 3,972,647 | A | 8/1976 | Niedermeyer |
| 3,976,919 | A | 8/1976 | Vandevier |
| 3,987,240 | A | 10/1976 | Schultz |
| 4,000,446 | A | 12/1976 | Vandevier |
| 4,021,700 | A | 5/1977 | Ellis-Anwyl |
| 4,030,450 | A | 6/1977 | Hoult |
| 4,041,470 | A | 8/1977 | Slane et al. |
| 4,061,442 | A | 12/1977 | Clark et al. |
| 4,087,204 | A | 5/1978 | Niedermeyer |
| 4,108,574 | A | 8/1978 | Bartley et al. |
| 4,123,792 | A | 10/1978 | Gephart et al. |
| 4,133,058 | A | 1/1979 | Baker |
| 4,142,415 | A | 3/1979 | Jung et al. |
| 4,151,080 | A | 4/1979 | Zuckerman et al. |
| 4,157,728 | A | 6/1979 | Mitamura et al. |
| 4,168,413 | A | 9/1979 | Halpine |
| 4,169,377 | A | 10/1979 | Scheib |
| 4,182,363 | A | 1/1980 | Fuller et al. |
| 4,185,187 | A | 1/1980 | Rogers |
| 4,187,503 | A | 2/1980 | Walton |
| 4,206,634 | A | 6/1980 | Taylor |
| 4,215,975 | A | 8/1980 | Niedermeyer |
| 4,222,711 | A | 9/1980 | Mayer |
| 4,225,290 | A | 9/1980 | Allington |
| 4,228,427 | A | 10/1980 | Niedermeyer |
| 4,233,553 | A | 11/1980 | Prince |
| 4,241,299 | A | 12/1980 | Bertone |
| 4,255,747 | A | 3/1981 | Bunia |
| 4,263,535 | A | 4/1981 | Jones |
| 4,276,454 | A | 6/1981 | Zathan |
| 4,286,303 | A | 8/1981 | Genheimer et al. |
| 4,303,203 | A | 12/1981 | Avery |
| 4,307,327 | A | 12/1981 | Streater et al. |
| 4,309,157 | A | 1/1982 | Niedermeyer |
| 4,314,478 | A | 2/1982 | Beaman |
| 4,319,712 | A | 3/1982 | Bar |
| 4,322,297 | A | 3/1982 | Bajka |
| 4,330,412 | A | 5/1982 | Frederick |
| 4,332,527 | A | 6/1982 | Moldovan et al. |
| 4,353,220 | A | 10/1982 | Curwein |
| 4,366,426 | A | 12/1982 | Turlej |
| 4,369,438 | A | 1/1983 | Wilhelmi |
| 4,370,098 | A | 1/1983 | McClain et al. |
| 4,370,690 | A | 1/1983 | Baker |
| 4,371,315 | A | 2/1983 | Shikasho |
| 4,375,613 | A | 3/1983 | Fuller et al. |
| 4,384,825 | A | 5/1983 | Thomas et al. |
| 4,394,262 | A | 7/1983 | Bukowski et al. |
| 4,399,394 | A | 8/1983 | Ballman |
| 4,402,094 | A | 9/1983 | Sanders |
| 4,409,532 | A | 10/1983 | Hollenbeck |
| 4,419,625 | A | 12/1983 | Bejot et al. |
| 4,420,787 | A | 12/1983 | Tibbits et al. |
| 4,421,643 | A | 12/1983 | Frederick |
| 4,425,836 | A | 1/1984 | Pickrell |
| 4,427,545 | A | 1/1984 | Arguilez |
| 4,428,434 | A | 1/1984 | Gelaude |
| 4,429,343 | A | 1/1984 | Freud |
| 4,437,133 | A | 3/1984 | Rueckert |
| 4,448,072 | A | 5/1984 | Tward |
| 4,449,260 | A | 5/1984 | Whitaker |
| 4,453,118 | A | 6/1984 | Phillips |
| 4,456,432 | A | 6/1984 | Mannino |
| 4,462,758 | A | 7/1984 | Speed |
| 4,463,304 | A | 7/1984 | Miller |
| 4,468,604 | A | 8/1984 | Zaderej |
| 4,470,092 | A | 9/1984 | Lombardi |
| 4,473,338 | A | 9/1984 | Garmong |
| 4,494,180 | A | 1/1985 | Streater |
| 4,496,895 | A | 1/1985 | Kawate et al. |
| 4,504,773 | A | 3/1985 | Suzuki et al. |
| 4,505,643 | A | 3/1985 | Millis et al. |
| D278,529 | S | 4/1985 | Hoogner |
| 4,514,989 | A | 5/1985 | Mount |
| 4,520,303 | A | 5/1985 | Ward |
| 4,529,359 | A | 7/1985 | Sloan |
| 4,541,029 | A | 9/1985 | Ohyama |
| 4,545,906 | A | 10/1985 | Frederick |
| 4,552,512 | A | 11/1985 | Gallup et al. |
| 4,564,041 | A | 1/1986 | Kramer |
| 4,564,882 | A | 1/1986 | Baxter |
| 4,581,900 | A | 4/1986 | Lowe |

(56) References Cited

U.S. PATENT DOCUMENTS 4,604,563 A 8/1986 Min
4,605,888 A 8/1986 Kim
4,610,605 A 9/1986 Hartley
4,620,835 A 11/1986 Bell
4,622,506 A 11/1986 Shemanske
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege
4,676,914 A 6/1987 Mills et al.
4,678,404 A 7/1987 Lorett et al.
4,678,409 A 7/1987 Kurokawa
4,686,439 A 8/1987 Cunningham
4,695,779 A 9/1987 Yates
4,697,464 A 10/1987 Martin
4,703,387 A 10/1987 Mller
4,705,629 A 11/1987 Weir
4,716,605 A 1/1988 Shepherd
4,719,399 A 1/1988 Wrege
4,728,882 A 3/1988 Stanbro
4,751,449 A 6/1988 Chmiel
4,751,450 A 6/1988 Lorenz
4,758,697 A 7/1988 Jeuneu
4,761,601 A 8/1988 Zaderej
4,764,417 A 8/1988 Gulya
4,764,714 A 8/1988 Alley
4,766,329 A 8/1988 Santiago
4,767,280 A 8/1988 Markuson
4,780,050 A 10/1988 Caine et al.
4,781,525 A 11/1988 Hubbard
4,782,278 A 11/1988 Bossi
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis
4,806,457 A 2/1989 Yanagisawa
4,820,964 A 4/1989 Kadah
4,827,197 A 5/1989 Giebler
4,834,624 A 5/1989 Jensen
4,837,656 A 6/1989 Barnes
4,839,571 A 6/1989 Farnham
4,841,404 A 6/1989 Marshall et al.
4,843,295 A 6/1989 Thompson
4,862,053 A 8/1989 Jordan
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi
4,958,118 A 9/1990 Pottebaum
4,963,778 A 10/1990 Jensen
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara
5,028,854 A 7/1991 Moline
5,041,771 A 8/1991 Min
5,051,068 A 9/1991 Wong
5,051,681 A 9/1991 Schwarz
5,076,761 A 12/1991 Krohn
5,076,763 A 12/1991 Anastos et al.
5,079,784 A 1/1992 Rist et al.
5,091,817 A 2/1992 Alley
5,098,023 A 3/1992 Burke
5,099,181 A 3/1992 Canon
5,100,298 A 3/1992 Shibata
RE33,874 E 4/1992 Miller
5,103,154 A 4/1992 Dropps
5,117,233 A 5/1992 Hamos et al.
5,123,080 A 6/1992 Gillett
5,129,264 A 7/1992 Lorenc
5,135,359 A 8/1992 Dufresne
5,145,323 A 9/1992 Farr
5,151,017 A 9/1992 Sears et al.
5,154,821 A 10/1992 Reid
5,156,535 A 10/1992 Budris
5,158,436 A 10/1992 Jensen
5,159,713 A 10/1992 Gaskell
5,164,651 A 11/1992 Hu
5,166,595 A 11/1992 Leverich
5,167,041 A 12/1992 Burkitt
5,172,089 A 12/1992 Wright et al.
D334,542 S 4/1993 Lowe
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin
5,238,369 A 8/1993 Far
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier
5,295,790 A 3/1994 Bossart et al.
5,295,857 A 3/1994 Toly
5,296,795 A 3/1994 Dropps
5,302,885 A 4/1994 Schwarz
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,360,320 A 11/1994 Jameson et al.
5,361,215 A 11/1994 Tompkins
5,363,912 A 11/1994 Wolcott
5,394,748 A 3/1995 McCarthy
5,418,984 A 5/1995 Livingston, Jr.
D359,458 S 6/1995 Pierret
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi
5,449,274 A 9/1995 Kochan, Jr.
5,449,997 A 9/1995 Gilmore et al.
5,450,316 A 9/1995 Gaudet et al.
D363,060 S 10/1995 Hunger
5,457,373 A 10/1995 Heppe et al.
5,457,826 A 10/1995 Haraga et al.
5,466,995 A 11/1995 Genga
5,469,215 A 11/1995 Nashiki
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein
5,519,848 A 5/1996 Wloka

(56) References Cited

U.S. PATENT DOCUMENTS 5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill
5,550,497 A 8/1996 Carobolante
5,550,753 A 8/1996 Tompkins et al.
5,559,418 A 9/1996 Burkhart
5,559,720 A 9/1996 Tompkins
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker
5,570,481 A 11/1996 Mathis et al.
5,571,000 A 11/1996 Zimmerman
5,577,890 A 11/1996 Nielson et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah
5,592,062 A 1/1997 Bach
5,598,080 A 1/1997 Jensen
5,601,413 A 2/1997 Langley
5,604,491 A 2/1997 Coonley et al.
5,614,812 A 3/1997 Wagoner
5,616,239 A 4/1997 Wendell et al.
5,618,460 A 4/1997 Fowler
5,622,223 A 4/1997 Vasquez
5,624,237 A 4/1997 Prescott et al.
5,626,464 A 5/1997 Schoenmeyr
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,337 A 1/1998 Breit et al.
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos et al.
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson
5,818,708 A 10/1998 Wong
5,818,714 A 10/1998 Zou
5,819,848 A 10/1998 Ramusson
5,820,350 A 10/1998 Mantey et al.
5,828,200 A 10/1998 Ligman et al.
5,833,437 A 11/1998 Kurth et al.
5,836,271 A 11/1998 Saski
5,845,225 A 12/1998 Mosher
5,856,783 A 1/1999 Gibb
5,863,185 A 1/1999 Cochimin et al.
5,883,489 A 3/1999 Konrad
5,884,205 A 3/1999 Elmore et al.
5,892,349 A 4/1999 Bogwicz
5,894,609 A 4/1999 Barnett
5,898,958 A 5/1999 Hall
5,906,479 A 5/1999 Hawes
5,907,281 A 5/1999 Miller, Jr. et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad
5,946,469 A 8/1999 Chidester
5,947,689 A 9/1999 Schick
5,947,700 A 9/1999 McKain et al.
5,959,431 A 9/1999 Xiang
5,959,534 A 9/1999 Campbell
5,961,291 A 10/1999 Sakagami et al.
5,963,706 A 10/1999 Baik
5,969,958 A 10/1999 Nielsen
5,973,465 A 10/1999 Rayner
5,973,473 A 10/1999 Anderson
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,080,973 A 6/2000 Thweatt, Jr.
6,081,751 A 6/2000 Luo
6,091,604 A 7/2000 Plougsgaard
6,092,992 A 7/2000 Imblum
6,094,026 A 7/2000 Cameron
D429,699 S 8/2000 Davis
D429,700 S 8/2000 Liebig
6,094,764 A 8/2000 Veloskey et al.
6,098,654 A 8/2000 Cohen et al.
6,102,665 A 8/2000 Centers et al.
6,110,322 A 8/2000 Teoh et al.
6,116,040 A 9/2000 Stark
6,119,707 A 9/2000 Jordan
6,121,746 A 9/2000 Fisher
6,121,749 A 9/2000 Wills et al.
6,125,481 A 10/2000 Sicilano
6,125,883 A 10/2000 Creps et al.
6,142,741 A 11/2000 Nishihata
6,146,108 A 11/2000 Mullendore
6,150,776 A 11/2000 Potter et al.
6,157,304 A 12/2000 Bennett et al.
6,164,132 A 12/2000 Matulek
6,171,073 B1 1/2001 McKain et al.
6,178,393 B1 1/2001 Irvin
6,184,650 B1 2/2001 Gelbman
6,188,200 B1 2/2001 Maiorano
6,198,257 B1 3/2001 Belehradek et al.
6,199,224 B1 3/2001 Versland
6,203,282 B1 3/2001 Morin
6,208,112 B1 3/2001 Jensen et al.
6,212,956 B1 4/2001 Donald

(56) References Cited

U.S. PATENT DOCUMENTS

| | | | |
|---|---|---|---|
| 6,213,724 | B1 | 4/2001 | Haugen |
| 6,216,814 | B1 | 4/2001 | Fujita et al. |
| 6,222,355 | B1 | 4/2001 | Ohshima |
| 6,227,808 | B1 | 5/2001 | Jensen et al. |
| 6,232,742 | B1 | 5/2001 | Wacknov |
| 6,236,177 | B1 | 5/2001 | Zick |
| 6,238,188 | B1 | 5/2001 | McDonough |
| 6,247,429 | B1 | 6/2001 | Hara |
| 6,249,435 | B1 | 6/2001 | Lifson |
| 6,251,285 | B1 | 6/2001 | Clochetti |
| 6,253,227 | B1 | 6/2001 | Vicente et al. |
| D445,405 | S | 7/2001 | Schneider |
| 6,254,353 | B1 | 7/2001 | Polo |
| 6,257,304 | B1 | 7/2001 | Jacobs et al. |
| 6,257,833 | B1 | 7/2001 | Bates |
| 6,259,617 | B1 | 7/2001 | Wu |
| 6,264,431 | B1 | 7/2001 | Trizenberg |
| 6,264,432 | B1 | 7/2001 | Kilayko et al. |
| 6,280,611 | B1 | 8/2001 | Henkin et al. |
| 6,282,370 | B1 | 8/2001 | Cline et al. |
| 6,298,721 | B1 | 10/2001 | Schuppe et al. |
| 6,299,414 | B1 | 10/2001 | Schoenmeyr |
| 6,299,699 | B1 | 10/2001 | Porat et al. |
| 6,318,093 | B2 | 11/2001 | Gaudet et al. |
| 6,320,348 | B1 | 11/2001 | Kadah |
| 6,326,752 | B1 | 12/2001 | Jensen et al. |
| 6,329,784 | B1 | 12/2001 | Puppin |
| 6,330,525 | B1 | 12/2001 | Hays |
| 6,342,841 | B1 | 1/2002 | Stingl |
| 6,349,268 | B1 | 2/2002 | Ketonen et al. |
| 6,350,105 | B1 | 2/2002 | Kobayashi et al. |
| 6,351,359 | B1 | 2/2002 | Jager |
| 6,354,805 | B1 | 3/2002 | Moeller |
| 6,355,177 | B2 | 3/2002 | Senner et al. |
| 6,356,464 | B1 | 3/2002 | Balakrishnan |
| 6,356,853 | B1 | 3/2002 | Sullivan |
| 6,362,591 | B1 | 3/2002 | Moberg |
| 6,364,620 | B1 | 4/2002 | Fletcher et al. |
| 6,364,621 | B1 | 4/2002 | Yamauchi |
| 6,366,053 | B1 | 4/2002 | Belehradek |
| 6,366,481 | B1 | 4/2002 | Balakrishnan |
| 6,369,463 | B1 | 4/2002 | Maiorano |
| 6,373,204 | B1 | 4/2002 | Peterson |
| 6,373,728 | B1 | 4/2002 | Aarestrup |
| 6,374,854 | B1 | 4/2002 | Acosta |
| 6,375,430 | B1 | 4/2002 | Eckert et al. |
| 6,380,707 | B1 | 4/2002 | Rosholm |
| 6,388,642 | B1 | 5/2002 | Cotis |
| 6,390,781 | B1 | 5/2002 | McDonough |
| 6,406,265 | B1 | 6/2002 | Hahn |
| 6,407,469 | B1 | 6/2002 | Cline et al. |
| 6,411,481 | B1 | 6/2002 | Seubert |
| 6,415,808 | B2 | 7/2002 | Joshi |
| 6,416,295 | B1 | 7/2002 | Nagai |
| 6,426,633 | B1 | 7/2002 | Thybo |
| 6,443,715 | B1 | 9/2002 | Mayleben et al. |
| 6,445,565 | B1 | 9/2002 | Toyoda et al. |
| 6,447,446 | B1 | 9/2002 | Smith et al. |
| 6,448,713 | B1 | 9/2002 | Farkas et al. |
| 6,450,771 | B1 | 9/2002 | Centers |
| 6,462,971 | B1 | 10/2002 | Balakrishnan et al. |
| 6,464,464 | B2 | 10/2002 | Sabini |
| 6,468,042 | B2 | 10/2002 | Moller |
| 6,468,052 | B2 | 10/2002 | McKain et al. |
| 6,474,949 | B1 | 11/2002 | Arai |
| 6,475,180 | B2 | 11/2002 | Peterson et al. |
| 6,481,973 | B1 | 11/2002 | Struthers |
| 6,483,278 | B2 | 11/2002 | Harvest |
| 6,483,378 | B2 | 11/2002 | Blodgett |
| 6,490,920 | B1 | 12/2002 | Netzer |
| 6,493,227 | B2 | 12/2002 | Nielson et al. |
| 6,496,392 | B2 | 12/2002 | Odel |
| 6,499,961 | B1 | 12/2002 | Wyatt |
| 6,501,629 | B1 | 12/2002 | Mariott |
| 6,503,063 | B1 | 1/2003 | Brunsell |
| 6,504,338 | B1 | 1/2003 | Eichorn |
| 6,520,010 | B1 | 2/2003 | Bergveld |
| 6,522,034 | B1 | 2/2003 | Nakayama |
| 6,523,091 | B2 | 2/2003 | Tirumala |
| 6,527,518 | B2 | 3/2003 | Ostrowski |
| 6,534,940 | B2 | 3/2003 | Bell et al. |
| 6,534,947 | B2 | 3/2003 | Johnson |
| 6,537,032 | B1 | 3/2003 | Horiuchi |
| 6,538,908 | B2 | 3/2003 | Balakrishnan et al. |
| 6,539,797 | B2 | 4/2003 | Livingston |
| 6,543,940 | B2 | 4/2003 | Chu |
| 6,548,976 | B2 | 4/2003 | Jensen |
| 6,564,627 | B1 | 5/2003 | Sabini |
| 6,570,778 | B2 | 5/2003 | Lipo et al. |
| 6,571,807 | B2 | 6/2003 | Jones |
| 6,590,188 | B2 | 7/2003 | Cline |
| 6,591,697 | B2 | 7/2003 | Henyan |
| 6,591,863 | B2 | 7/2003 | Ruschell |
| 6,595,051 | B1 | 7/2003 | Chandler, Jr. |
| 6,595,762 | B2 | 7/2003 | Khanwilkar et al. |
| 6,604,909 | B2 | 8/2003 | Schoenmeyr |
| 6,607,360 | B2 | 8/2003 | Fong |
| 6,616,413 | B2 | 9/2003 | Humpheries |
| 6,623,245 | B2 | 9/2003 | Meza et al. |
| 6,625,824 | B1 | 9/2003 | Lutz et al. |
| 6,626,840 | B2 | 9/2003 | Drzewiecki |
| 6,628,501 | B2 | 9/2003 | Toyoda |
| 6,632,072 | B2 | 10/2003 | Lipscomb et al. |
| 6,636,135 | B1 | 10/2003 | Vetter |
| 6,638,023 | B2 | 10/2003 | Scott |
| D482,664 | S | 11/2003 | Hunt |
| 6,643,153 | B2 | 11/2003 | Balakrishnan |
| 6,651,900 | B1 | 11/2003 | Yoshida |
| 6,655,922 | B1 | 12/2003 | Flek |
| 6,663,349 | B1 | 12/2003 | Discenzo et al. |
| 6,665,200 | B2 | 12/2003 | Goto |
| 6,672,147 | B1 | 1/2004 | Mazet |
| 6,675,912 | B2 | 1/2004 | Carrier |
| 6,676,382 | B2 | 1/2004 | Leighton et al. |
| 6,676,831 | B2 | 1/2004 | Wolfe |
| 6,687,141 | B2 | 2/2004 | Odell |
| 6,687,923 | B2 | 2/2004 | Dick |
| 6,690,250 | B2 | 2/2004 | Moller |
| 6,696,676 | B1 | 2/2004 | Graves et al. |
| 6,700,333 | B1 | 3/2004 | Hirshi et al. |
| 6,709,240 | B1 | 3/2004 | Schmalz |
| 6,709,241 | B2 | 3/2004 | Sabini |
| 6,709,575 | B1 | 3/2004 | Verdegan |
| 6,715,996 | B2 | 4/2004 | Moeller |
| 6,717,318 | B1 | 4/2004 | Mathiasssen |
| 6,732,387 | B1 | 5/2004 | Waldron |
| 6,737,905 | B1 | 5/2004 | Noda |
| D490,726 | S | 6/2004 | Eungprabhanth |
| 6,742,387 | B2 | 6/2004 | Hamamoto |
| 6,747,367 | B2 | 6/2004 | Cline et al. |
| 6,758,655 | B2 | 7/2004 | Sacher |
| 6,761,067 | B1 | 7/2004 | Capano |
| 6,768,279 | B1 | 7/2004 | Skinner |
| 6,770,043 | B1 | 8/2004 | Kahn |
| 6,774,664 | B2 | 8/2004 | Godbersen |
| 6,776,038 | B1 | 8/2004 | Horton et al. |
| 6,776,584 | B2 | 8/2004 | Sabini et al. |
| 6,778,868 | B2 | 8/2004 | Imamura et al. |
| 6,779,205 | B2 | 8/2004 | Mulvey |
| 6,779,950 | B1 | 8/2004 | Meier et al. |
| 6,782,309 | B2 | 8/2004 | Laflamme |
| 6,783,328 | B2 | 8/2004 | Lucke |
| 6,789,024 | B1 | 9/2004 | Kochan, Jr. et al. |
| 6,794,921 | B2 | 9/2004 | Abe |
| 6,797,164 | B2 | 9/2004 | Leaverton |
| 6,798,271 | B2 | 9/2004 | Swize |
| 6,799,950 | B2 | 10/2004 | Meier et al. |
| 6,806,677 | B2 | 10/2004 | Kelly et al. |
| 6,837,688 | B2 | 1/2005 | Kimberlin et al. |
| 6,842,117 | B2 | 1/2005 | Keown |
| 6,847,130 | B1 | 1/2005 | Belehradek et al. |
| 6,847,854 | B2 | 1/2005 | Discenzo |
| 6,854,479 | B2 | 2/2005 | Harwood |
| 6,863,502 | B2 | 3/2005 | Bishop et al. |

(56) References Cited

U.S. PATENT DOCUMENTS 6,867,383 B1 3/2005 Currier
6,875,961 B1 4/2005 Collins
6,882,165 B2 4/2005 Ogura
6,884,022 B2 4/2005 Albright
D504,900 S 5/2005 Wang
D505,429 S 5/2005 Wang
6,888,537 B2 5/2005 Albright
6,895,608 B2 5/2005 Goettl
6,900,736 B2 5/2005 Crumb
6,906,482 B2 6/2005 Shimizu
D507,243 S 7/2005 Miller
6,914,793 B2 7/2005 Balakrishnan
6,922,348 B2 7/2005 Nakajima
6,925,823 B2 8/2005 Lifson
6,933,693 B2 8/2005 Schuchmann
6,941,785 B2 9/2005 Haynes et al.
6,943,325 B2 9/2005 Pittman
6,973,794 B2 9/2005 Street
D511,530 S 11/2005 Wang
D512,026 S 11/2005 Nurmi
6,965,815 B1 11/2005 Tompkins et al.
6,966,967 B2 11/2005 Curry
D512,440 S 12/2005 Wang
6,973,974 B2 12/2005 McLoughlin et al.
6,976,052 B2 12/2005 Tompkins et al.
D513,737 S 1/2006 Riley
6,981,399 B1 1/2006 Nubp et al.
6,981,402 B2 1/2006 Bristol
6,984,158 B2 1/2006 Satoh
6,989,649 B2 1/2006 Melhorn
6,993,414 B2 1/2006 Shah
6,998,807 B2 2/2006 Phillips
6,998,977 B2 2/2006 Gregori et al.
7,005,818 B2 2/2006 Jensen
7,012,394 B2 3/2006 Moore et al.
7,015,599 B2 3/2006 Gull et al.
7,040,107 B2 5/2006 Lee et al.
7,042,192 B2 5/2006 Mehlhorn
7,050,278 B2 5/2006 Poulsen
7,055,189 B2 6/2006 Goettl
7,070,134 B1 7/2006 Hoyer
7,077,781 B2 7/2006 Ishikawa
7,080,508 B2 7/2006 Stavale
7,081,728 B2 7/2006 Kemp
7,083,392 B2 8/2006 Meza
7,083,438 B2 8/2006 Massaro et al.
7,089,607 B2 8/2006 Barnes et al.
7,100,632 B2 9/2006 Harwood
7,102,505 B2 9/2006 Kates
7,107,184 B2 9/2006 Gentile et al.
7,112,037 B2 9/2006 Sabini et al.
7,114,926 B2 10/2006 Oshita
7,117,120 B2 10/2006 Beck et al.
7,141,210 B2 11/2006 Bell
7,142,932 B2 11/2006 Spria et al.
D533,512 S 12/2006 Nakashima
7,163,380 B2 1/2007 Jones
7,172,366 B1 2/2007 Bishop, Jr.
7,174,273 B2 2/2007 Goldberg
7,178,179 B2 2/2007 Barnes
7,183,741 B2 2/2007 Mehlhorn
7,195,462 B2 3/2007 Nybo et al.
7,201,563 B2 4/2007 Studebaker
7,221,121 B2 5/2007 Skaug
7,244,106 B2 7/2007 Kallaman
7,245,105 B2 7/2007 Joo
7,259,533 B2 8/2007 Yang et al.
7,264,449 B1 9/2007 Harned et al.
7,281,958 B2 10/2007 Schuttler et al.
7,292,898 B2 11/2007 Clark et al.
7,307,538 B2 12/2007 Kochan, Jr.
7,309,216 B1 12/2007 Spadola et al.
7,318,344 B2 1/2008 Heger
D562,349 S 2/2008 Bulter
7,327,275 B2 2/2008 Brochu
7,339,126 B1 3/2008 Niedermeyer
D567,189 S 4/2008 Stiles, Jr.
7,352,550 B2 4/2008 Mladenik
7,375,940 B1 5/2008 Bertrand
7,388,348 B2 6/2008 Mattichak
7,407,371 B2 8/2008 Leone
7,427,844 B2 9/2008 Mehlhorn
7,429,842 B2 9/2008 Schulman et al.
7,437,215 B2 10/2008 Anderson et al.
D582,797 S 12/2008 Fraser
D583,828 S 12/2008 Li
7,458,782 B1 12/2008 Spadola et al.
7,459,886 B1 12/2008 Potanin et al.
7,484,938 B2 2/2009 Allen
7,516,106 B2 4/2009 Ehlers
7,517,351 B2 4/2009 Culp et al.
7,525,280 B2 4/2009 Fagan et al.
7,528,579 B2 5/2009 Pacholok et al.
7,542,251 B2 6/2009 Ivankovic
7,542,252 B2 6/2009 Chan et al.
7,572,108 B2 8/2009 Koehl
7,612,510 B2 11/2009 Koehl
7,612,529 B2 11/2009 Kochan, Jr.
7,623,986 B2 11/2009 Miller
7,641,449 B2 1/2010 Iimura et al.
7,652,441 B2 1/2010 Ho
7,686,587 B2 3/2010 Koehl
7,686,589 B2 3/2010 Stiles et al.
7,690,897 B2 4/2010 Branecky
7,700,887 B2 4/2010 Niedermeyer
7,704,051 B2 4/2010 Koehl
7,707,125 B2 4/2010 Haji-Valizadeh
7,727,181 B2 6/2010 Rush
7,739,733 B2 6/2010 Szydlo
7,746,063 B2 6/2010 Sabini et al.
7,751,159 B2 7/2010 Koehl
7,753,880 B2 7/2010 Malackowski
7,755,318 B1 7/2010 Panosh
7,775,327 B2 8/2010 Abraham
7,777,435 B2 8/2010 Aguilar
7,788,877 B2 9/2010 Andras
7,795,824 B2 9/2010 Shen et al.
7,808,211 B2 10/2010 Pacholok et al.
7,815,420 B2 10/2010 Koehl
7,821,215 B2 10/2010 Koehl
7,845,913 B2 12/2010 Stiles et al.
7,854,597 B2 12/2010 Stiles et al.
7,857,600 B2 12/2010 Koehl
7,874,808 B2 1/2011 Stiles
7,878,766 B2 2/2011 Meza
7,900,308 B2 3/2011 Erlich
7,925,385 B2 4/2011 Stavale et al.
7,931,447 B2 4/2011 Levin et al.
7,945,411 B2 5/2011 Keman et al.
7,976,284 B2 7/2011 Koehl
7,983,877 B2 7/2011 Koehl
7,990,091 B2 8/2011 Koehl
8,007,255 B2 8/2011 Hattori et al.
8,011,895 B2 9/2011 Ruffo
8,019,479 B2 9/2011 Stiles
8,032,256 B1 10/2011 Wolf et al.
8,043,070 B2 10/2011 Stiles
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,164,470 B2 4/2012 Brochu et al.
8,177,520 B2 5/2012 Mehlhorn
8,281,425 B2 10/2012 Cohen
8,299,662 B2 10/2012 Schmidt et al.
8,303,260 B2 11/2012 Stavale et al.
8,313,306 B2 * 11/2012 Stiles, Jr. ..... F04B 49/10 417/26
8,316,152 B2 11/2012 Geltner et al.
8,317,485 B2 11/2012 Meza et al.
8,337,166 B2 12/2012 Meza et al.
8,380,355 B2 2/2013 Mayleben et al.

(56) References Cited

U.S. PATENT DOCUMENTS 8,405,346 B2 3/2013 Trigiani
8,405,361 B2 3/2013 Richards et al.
8,444,394 B2 5/2013 Koehl
8,465,262 B2 6/2013 Stiles et al.
8,469,675 B2 6/2013 Stiles et al.
8,480,373 B2 7/2013 Stiles et al.
8,500,413 B2 8/2013 Stiles et al.
8,540,493 B2 9/2013 Koehl
8,547,065 B2 10/2013 Trigiani
8,573,952 B2 11/2013 Stiles et al.
8,579,600 B2 11/2013 Vijayakumar
8,602,745 B2 12/2013 Stiles
8,641,383 B2 2/2014 Meza
8,641,385 B2 2/2014 Koehl
8,669,494 B2 3/2014 Tran
8,756,991 B2 6/2014 Edwards
8,763,315 B2 7/2014 Hartman
8,774,972 B2 7/2014 Rusnak
8,801,389 B2 8/2014 Stiles, Jr. et al.
8,981,684 B2 3/2015 Drye et al.
9,030,066 B2 5/2015 Drye
9,051,930 B2 6/2015 Stiles, Jr. et al.
9,238,918 B2 1/2016 McKinzie
9,551,344 B2 * 1/2017 Stiles, Jr. ..... F04B 49/20
9,822,782 B2 11/2017 McKinzie
2001/0002238 A1 5/2001 McKain
2001/0029407 A1 10/2001 Tompkins
2001/0041139 A1 11/2001 Sabini et al.
2002/0000789 A1 1/2002 Haba
2002/0002989 A1 1/2002 Jones
2002/0010839 A1 1/2002 Tirumalal et al.
2002/0018721 A1 2/2002 Kobayashi
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson
2002/0101193 A1 8/2002 Farkas
2002/0111554 A1 8/2002 Drzewiecki
2002/0131866 A1 9/2002 Phillips
2002/0136642 A1 9/2002 Moller
2002/0143478 A1 10/2002 Vanderah et al.
2002/0150476 A1 10/2002 Lucke
2002/0163821 A1 11/2002 Odell
2002/0172055 A1 11/2002 Balakrishnan
2002/0176783 A1 11/2002 Moeller
2002/0190687 A1 12/2002 Bell et al.
2003/0000303 A1 1/2003 Livingston
2003/0017055 A1 1/2003 Fong
2003/0030954 A1 2/2003 Bax et al.
2003/0034284 A1 2/2003 Wolfe
2003/0034761 A1 2/2003 Goto
2003/0048646 A1 3/2003 Odell
2003/0049134 A1 3/2003 Leighton et al.
2003/0063900 A1 4/2003 Wang et al.
2003/0099548 A1 5/2003 Meza
2003/0106147 A1 6/2003 Cohen et al.
2003/0061004 A1 7/2003 Discenzo
2003/0138327 A1 7/2003 Jones et al.
2003/0174450 A1 9/2003 Nakajima et al.
2003/0186453 A1 10/2003 Bell
2003/0196942 A1 10/2003 Jones
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Lloyd et al.
2004/0055363 A1 3/2004 Bristol
2004/0062658 A1 4/2004 Beck et al.
2004/0064292 A1 4/2004 Beck
2004/0071001 A1 4/2004 Balakrishnan
2004/0080325 A1 4/2004 Ogura
2004/0080352 A1 4/2004 Noda
2004/0090197 A1 5/2004 Schuchmann
2004/0095183 A1 5/2004 Swize
2004/0116241 A1 6/2004 Ishikawa
2004/0117330 A1 6/2004 Ehlers et al.
2004/0118203 A1 6/2004 Heger
2004/0149666 A1 8/2004 Ehlers et al.
2004/0205886 A1 10/2004 Goettel
2004/0213676 A1 10/2004 Phillips
2004/0261167 A1 12/2004 Panopoulos
2004/0265134 A1 12/2004 Iimura et al.
2005/0050908 A1 3/2005 Lee et al.
2005/0058548 A1 3/2005 Thomas et al.
2005/0086957 A1 4/2005 Lifson
2005/0092946 A1 5/2005 Fellington et al.
2005/0095150 A1 5/2005 Leone et al.
2005/0097665 A1 5/2005 Goettel
2005/0123408 A1 6/2005 Koehl
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1 8/2005 Brochu et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik
2005/0226731 A1 10/2005 Mehlhorn
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0106503 A1 5/2006 Lamb et al.
2006/0127227 A1 6/2006 Mehlhorn
2006/0138033 A1 6/2006 Hoal et al.
2006/0146462 A1 7/2006 McMillian et al.
2006/0162787 A1 7/2006 Yeh
2006/0169322 A1 8/2006 Torkelson
2006/0201555 A1 9/2006 Hamza
2006/0204367 A1 9/2006 Meza
2006/0226997 A1 10/2006 Kochan, Jr.
2006/0235573 A1 10/2006 Guion
2006/0269426 A1 11/2006 Llewellyn
2007/0001635 A1 1/2007 Ho
2007/0041845 A1 2/2007 Freudenberger
2007/0061051 A1 3/2007 Maddox
2007/0080660 A1 4/2007 Fagan et al.
2007/0113647 A1 5/2007 Mehlhorn
2007/0114162 A1 5/2007 Stiles et al.
2007/0124321 A1 5/2007 Szydlo
2007/0154319 A1 7/2007 Stiles
2007/0154320 A1 7/2007 Stiles
2007/0154321 A1 7/2007 Stiles
2007/0154322 A1 7/2007 Stiles
2007/0154323 A1 7/2007 Stiles
2007/0160480 A1 7/2007 Ruffo
2007/0163929 A1 7/2007 Stiles
2007/0177985 A1 8/2007 Walls et al.
2007/0183902 A1 8/2007 Stiles
2007/0187185 A1 8/2007 Abraham et al.
2007/0188129 A1 8/2007 Kochan, Jr.
2007/0212210 A1 9/2007 Keman et al.
2007/0212229 A1 9/2007 Stavale et al.
2007/0212230 A1 9/2007 Stavale et al.
2007/0219652 A1 9/2007 McMillan
2007/0258827 A1 11/2007 Gierke
2008/0003114 A1 1/2008 Levin et al.

(56) References Cited

U.S. PATENT DOCUMENTS

| | | | |
|---|---|---|---|
| 2008/0031751 | A1 | 2/2008 | Littwin et al. |
| 2008/0031752 | A1 | 2/2008 | Littwin et al. |
| 2008/0039977 | A1 | 2/2008 | Clark et al. |
| 2008/0041839 | A1 | 2/2008 | Tran |
| 2008/0044293 | A1 | 2/2008 | Hanke et al. |
| 2008/0063535 | A1 | 3/2008 | Koehl |
| 2008/0095638 | A1 | 4/2008 | Branecky |
| 2008/0095639 | A1 | 4/2008 | Bartos |
| 2008/0131286 | A1 | 6/2008 | Ota |
| 2008/0131289 | A1 | 6/2008 | Koehl |
| 2008/0131291 | A1 | 6/2008 | Koehl |
| 2008/0131294 | A1 | 6/2008 | Koehl |
| 2008/0131295 | A1 | 6/2008 | Koehl |
| 2008/0131296 | A1 | 6/2008 | Koehl |
| 2008/0140353 | A1 | 6/2008 | Koehl |
| 2008/0152508 | A1 | 6/2008 | Meza |
| 2008/0168599 | A1 | 7/2008 | Caudill |
| 2008/0181785 | A1 | 7/2008 | Koehl |
| 2008/0181786 | A1 | 7/2008 | Meza |
| 2008/0181787 | A1 | 7/2008 | Koehl |
| 2008/0181788 | A1 | 7/2008 | Meza |
| 2008/0181789 | A1 | 7/2008 | Koehl |
| 2008/0181790 | A1 | 7/2008 | Meza |
| 2008/0189885 | A1 | 8/2008 | Erlich |
| 2008/0229819 | A1 | 9/2008 | Mayleben et al. |
| 2008/0260540 | A1 | 10/2008 | Koehl |
| 2008/0288115 | A1 | 11/2008 | Rusnak et al. |
| 2008/0298978 | A1 | 12/2008 | Schulman et al. |
| 2009/0014044 | A1 | 1/2009 | Hartman |
| 2009/0038696 | A1 | 2/2009 | Levin et al. |
| 2009/0052281 | A1 | 2/2009 | Nybo |
| 2009/0104044 | A1 | 4/2009 | Koehl |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2009/0290991 | A1 | 11/2009 | Mehlhorn et al. |
| 2010/0079096 | A1 | 4/2010 | Braun et al. |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0061415 | A1 | 3/2011 | Ward |
| 2011/0066256 | A1 | 3/2011 | Sesay et al. |
| 2011/0077875 | A1 | 3/2011 | Tran |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0013285 | A1 | 1/2012 | Kasunich et al. |
| 2012/0020810 | A1 | 1/2012 | Stiles, Jr. et al. |
| 2012/0100010 | A1 | 4/2012 | Stiles et al. |
| 2013/0106217 | A1 | 5/2013 | Drye |
| 2013/0106321 | A1 | 5/2013 | Drye et al. |
| 2013/0106322 | A1 | 5/2013 | Drye |
| 2014/0018961 | A1 | 1/2014 | Guzelgunler |
| 2014/0372164 | A1 | 12/2014 | Egan et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 1821574 | A | 8/2006 |
| CN | 101165352 | | 4/2008 |
| DE | 3023463 | A1 | 2/1981 |
| DE | 2946049 | A1 | 5/1981 |
| DE | 29612980 | U1 | 10/1996 |
| DE | 19736079 | A1 | 8/1997 |
| DE | 19645129 | A1 | 5/1998 |
| DE | 29724347 | U1 | 11/2000 |
| DE | 10231773 | A1 | 2/2004 |
| DE | 19938490 | B4 | 4/2005 |
| EP | 0150068 | A2 | 7/1985 |
| EP | 0226858 | A1 | 7/1987 |
| EP | 0246769 | A2 | 11/1987 |
| EP | 0306814 | A1 | 3/1989 |
| EP | 0314249 | A1 | 3/1989 |
| EP | 0709575 | A1 | 5/1996 |
| EP | 0735273 | A1 | 10/1996 |
| EP | 0833436 | A2 | 4/1998 |
| EP | 0831188 | A3 | 2/1999 |
| EP | 0978657 | A1 | 2/2000 |
| EP | 1112680 | A2 | 4/2001 |
| EP | 1134421 | A1 | 9/2001 |
| EP | 0916026 | | 5/2002 |
| EP | 1315929 | | 6/2003 |
| EP | 1429034 | A2 | 6/2004 |
| EP | 1585205 | A2 | 10/2005 |
| EP | 1630422 | A2 | 3/2006 |
| EP | 1698815 | A1 | 9/2006 |
| EP | 1790858 | A1 | 5/2007 |
| EP | 1995462 | A2 | 11/2008 |
| EP | 2102503 | A2 | 9/2009 |
| EP | 2122171 | A1 | 11/2009 |
| EP | 2122172 | A1 | 11/2009 |
| EP | 2273125 | A1 | 1/2011 |
| FR | 2529965 | A1 | 1/1984 |
| FR | 2703409 | A1 | 10/1994 |
| GB | 2124304 | A1 | 2/1984 |
| JP | 55072678 | A | 5/1980 |
| JP | 5010270 | A | 1/1993 |
| MX | 2009006258 | A1 | 12/2009 |
| WO | 98/04835 | A1 | 2/1998 |
| WO | 00/42339 | A1 | 7/2000 |
| WO | 01/27508 | A1 | 4/2001 |
| WO | 01/47099 | A1 | 6/2001 |
| WO | 02/018826 | A1 | 3/2002 |
| WO | 03/025442 | A1 | 3/2003 |
| WO | 03/099705 | A2 | 12/2003 |
| WO | 2004/006416 | A1 | 1/2004 |
| WO | 2004/073772 | A1 | 9/2004 |
| WO | 2004/088694 | A1 | 10/2004 |
| WO | 05/011473 | A1 | 2/2005 |
| WO | 2005011473 | A3 | 2/2005 |
| WO | 2005/055694 | A1 | 6/2005 |
| WO | 2005111473 | A2 | 11/2005 |
| WO | 2006/069568 | A1 | 7/2006 |
| WO | 2008/073329 | A1 | 6/2008 |
| WO | 2008/073330 | A1 | 6/2008 |
| WO | 2008073386 | A1 | 6/2008 |
| WO | 2008073413 | A1 | 6/2008 |
| WO | 2008073418 | A1 | 6/2008 |
| WO | 2008073433 | A1 | 6/2008 |
| WO | 2008073436 | A1 | 6/2008 |
| WO | 2011/100067 | A1 | 8/2011 |
| WO | 2014152926 | A1 | 9/2014 |
| ZA | 200506869 | | 5/2006 |
| ZA | 200509691 | | 11/2006 |
| ZA | 200904747 | | 7/2010 |
| ZA | 200904849 | | 7/2010 |
| ZA | 200904850 | | 7/2010 |

OTHER PUBLICATIONS

USPTO Patent Trial and Appeal Board, Paper 43—Final Written Decision, Case IPR2013-00287, U.S. Pat. No. 7,704,051 B2, dated Nov. 19, 2014, 28 pages.

Danfoss, VLT 8000 Aqua Operating Instructions, coded MG.80.A2.02 in the footer, 181 pages.

(56) References Cited

OTHER PUBLICATIONS

Per Brath—Danfoss Drives A/S, Towards Autonomous Control of HVAC Systems, thesis with translation of Introduction, Sep. 1999, 216 pages.
Karl Johan Åström and Björn Wittenmark—Lund Institute of Technology, Adaptive Control—Second Edition, book, Copyright 1995, 589 pages, Addison-Wesley Publishing Company, United States and Canada.
Bimal K. Bose—The University of Tennessee, Knoxville, Modern Power Electronics and A/C Drives, book, Copyright 2002, 728 pages, Prentice-Hall, Inc., Upper Saddle River, New Jersey.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Microchip Technology Inc., PICmicro® Advanced Analog Microcontrollers for 12-Bit ADC on 8-Bit MCUs, Convert to Microchip, brochure, Dec. 2000, 6 pages, Chandler, Arizona.
W.K. Ho, S.K. Panda, K.W. Lim, F.S. Huang—Department of Electrical Engineering, National University of Singapore, Gain-scheduling control of the Switched Reluctance Motor, Control Engineering Practice 6, copyright 1998, pp. 181-189, Elsevier Science Ltd.
Jan Eric Thorsen—Danfoss, Technical Paper—Dynamic simulation of DH House Stations, presented by 7. Dresdner Fernwärme-Kolloquium Sep. 2002, 10 pages, published in Euro Heat & Power Jun. 2003.
Texas Instruments, Electronic TMS320F/C240 DSP Controllers Reference Guide, Peripheral Library and Specific Devices, Jun. 1999, 474 pages.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, TEMPUS Publications, Great Britain.
James Shirley, et al., A mechatronics and material handling systems laboratory: experiments and case studies, International Journal of Electrical Engineering Education 48/1, pp. 92-103.
U.S. Court of Appeals for the Federal Circuit, Notice of Entry of Judgment, accompanied by Opinion, in Case No. 2017-1021, Document 57-1, filed and entered Feb. 7, 2018, pp. 1-16.
U.S. Court of Appeals for the Federal Circuit, Notice of Entry of Judgment, accompanied by Opinion, in Case No. 2017-1124, Document 54-1, filed and entered Feb. 26, 2018, pp. 1-10.
9PX-42—Hayward Pool Systems; "Hayward EcoStar & EcoStar SVRS Variable Speed Pumps Brochure;" Civil Action 5:11-cv-00459D; 2010.
205-24-Exh23—Piaintiff's Preliminary Disclosure of Asserted Claims and Preliminary Infringement Contentions; cited in Civil Action 5:11-cv-00459; Feb. 21, 2012.
PX-34—Pentair; "IntelliTouch Pool & Spa Control System User's Guide"; pp. 1-129; 2011; cited in Civil Action 5:11-cv-00459;2011.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-004590.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Commander; "Commander SE Advanced User Guide;" Nov. 2002; pp. 1-118.
Baldor; "Baldor Series 10 Inverter Control: Installation and Operating Manual"; Feb. 2000; pp. 1-74.
Dinverter; "Dinverter 28 User Guide;" Nov. 1998; pp. 1-94.
Pentair Pool Products, "IntelliFlo 4×160 a Breakthrough Energy-Efficiency and Service Life; " pp. 1-4; Nov. 2005; www.pentairpool.com.
Pentair Water and Spa, Inc. "The Pool Pro's guide to Breakthrough Efficiency, Convenience & Profitability," pp. 1-8, Mar. 2006; www.pentairpool.com.
Danfoss; "VLT8000 Aqua Instruction Manual;" Apr. 16, 2004; pp. 1-71.
"Product Focus—New AC Drive Series Target Water, Wastewater Applications;" WaterWorld Articles; Jul. 2002; pp. 1-2.
Pentair, "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Brochure entitled "Constant Pressure Water for Private Well Systems," for Myers Pentair Pump Group, Jun. 28, 2000.
Brochure for AMTROL, Inc. entitled "AMTROL unearths the facts about variable speed pumps and constant pressure valves," Mar. 2002.
Undated Goulds Pumps "Balanced Flow Systems" Installation Record.
Texas Instruments, Digital Signal Processing Solution for AC Induction Motor, Application Note, BPRA043 (1996).
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
Texas Instruments, TMS320F/C240 DSP Controllers Reference Guide Peripheral Library and Specific Devices, Literature No. SPRU 161D (Nov. 2002).
Texas Instruments, MSP430x33x—Mixed Signal Microcontrollers, SLAS 163 (Feb. 1998).
Microchip Technology, Inc., PICMicro Mid-Range MCU Family Reference Manual (Dec. 1997).
7-Motion for Preliminary Injunction by Danfoss Drives A/S & Pentair Water Pool & Spa, Inc. with respect to Civil Action No. 5:11-cv-00459D, filed Sep. 30, 2011.
540X48—Hopkins; "Partitioning Oigitally . . . Applications to Ballasts;" pp. 1-6; cited in Civil Action 5:11-cv-00459D, Mar. 2002.
Load Controls Incorporated, product web pages including Affidavit of Christopher Butler of Internet Archive attesting to the authenticity of the web pages, dated Apr. 17, 2013, 19 pages.
Cliff Wyatt, "Monitoring Pumps," World Pumps, vol. 2004, Issue 459, Dec. 2004, pp. 17-21.
Wen Technology, Inc., Unipower® HPL110 Digital Power Monitor Installation and Operation, copyright 1999, pp. 1-20, Raleigh, North Carolina.
Wen Technology, Inc., Unipower® HPL110, HPL420 Programming Suggestions for Centrifugal Pumps, copyright 1999, 4 pages, Raleigh, North Carolina.
Danfoss, VLT® Aqua Drive, "The ultimate solution for Water, Wastewater, & Irrigation", May 2007, pp. 1-16.
Danfoss, Salt Drive Systems, "Increase oil & gas production, Minimize energy consumption", copyright 2011, pp. 1-16.
Schlumberger Limited, Oilfield Glossary, website Search Results for "pump-off", copyright 2014, 1 page.
45—Plaintiffs' Reply to Defendants' Answer to Complaint & Counterclaim for Civil Action 5:11-cv-00459D, filed Nov. 2, 2011.
50—Amended Answer to Complaint & Counterclaim by Defendants for Civil Action 5:11-cv-00459D, filed Nov. 23, 2011.
54DX32—Hopkins; "High-Temperature, High-Density . . . Embedded Operation;" pp. 1-8; cited in Civil Action 5:11-cv-00459D, Mar. 2006.
Pentair; "Pentair IntelliTouch Operating Manual;" May 22, 2003; pp. 1-60.
Board Decision for Appeal 2015-007909, Reexamination Control No. 95/002,008, U.S. Pat. No. 7,686,587B2 dated Apr. 1, 2016.
U.S. Appl. No. 12/869,570 Appeal Decision dated May 24, 2016.

(56) References Cited

OTHER PUBLICATIONS

USPTO Patent Board Decision—Examiner Reversed; Appeal No. 2015-007909 re: U.S. Pat. No. 7,686,58762; dated Apr. 1, 2016.
USPTO Patent Board Decision—Examiner Affirmed in Part; Appeal No. 2016-002780 re: U.S. Pat. No. 7,854,597B2; dated Aug. 30, 2016.
USPTO Patent Board Decision—Decision on Reconsideration, Denied; Appeal No. 2015-007909 re: U.S. Pat. No. 7,686,587B2; dated Aug. 30, 2016.
Board Decision for Appeal 2016-002726, Reexamination Control No. 95/002,005, U.S. Pat. No. 7,857,600B2 dated Jul. 1, 2016.
Bibliographic Data Sheet—U.S. Appl. No. 10/730,747 Applicant: Robert M. Koehl Reasons for Inclusion: Printed publication US 2005/0123408 A1 for U.S. Appl. No. 10/730,747 has incorrect filing date.
Shabnam Moghanrabi; "Better, Stronger, Faster;" Pool & Spa News, Sep. 3, 2004; pp. 1-5; www/poolspanews.com.
Grundfos Pumps Corporation; "The New Standard in Submersible Pumps;" Brochure; pp. 1-8; Jun. 1999; Fresno, CA USA.
Grundfos Pumps Corporation; "Grundfos SQ/SQE Data Book;" pp. 1-39; Jun. 1999; Fresno, CA USA.
Goulds Pumps; "Balanced Flow System Brochure;" pp. 1-4; 2001.
Goulds Pumps; "Balanced Flow Submersible System Installation, Operation & Trouble-Shooting Manual;" pp. 1-9; 2000; USA.
Goulds Pumps; "Balanced Flow Submersible System Informational Seminar;" pp. 1-22; Undated.
Goulds Pumps; "Balanced Flow System Variable Speed Submersible Pump" Specification Sheet; pp. 1-2; Jan. 2000; USA.
Goulds Pumps; Advertisement from "Pumps & Systems Magazine;" entitled "Cost Effective Pump Protection+ Energy Savings," Jan. 2002; Seneca Falls, NY.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan 2001; USA.
Goulds Pumps; "Balanced Flow System Model BFSS Variable Speed Submersible Pump" Brochure; pp. 1-3; Jan. 2000; USA.
Goulds Pumps; "Balanced Flow System . . . The Future of Constant Pressure Has Arrived;" Undated Advertisement.
Amtrol Inc.; "AMTROL Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Grundfos; "SQ/SQE—A New Standard in Submersible Pumps;" Undated Brochure; pp. 1-14; Denmark.
Grundfos; "JetPaq—The Complete Pumping System;" Undated Brochure; pp. 1-4; Clovis, CA USA.
Email Regarding Grundfos' Price Increases/SQ/SQE Curves; pp. 1-7; Dec. 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.
Bjarke Soerensen; "Have You Chatted With Your Pump Today?" Undated Article Reprinted with Permission of Grundfos Pump University; pp. 1-2; USA.
"Understanding Constant Pressure Control;" pp. 1-3; Nov. 1, 1999.
"Constant Pressure is the Name of the Game;" Published Article from National Driller; Mar. 2001.
Sje-Rhombus; "Variable Frequency Drives for Constant Pressure Control;" Aug. 2008; pp. 1-4; Detroit Lakes, MN USA.
Sje-Rhombus; "Constant Pressure Controller for Submersible Well Pumps;" Jan. 2009; pp. 1-4; Detroit Lakes, MN USA.
Sje-Rhombus; "SubCon Variable Frequency Drive;" Dec. 2008; pp. 1-2; Detroit Lakes, MN USA.
Grundfos; "SmartFio SQE Constant Pressure System;" Mar. 2002; pp. 1-4; Olathe, KS USA.
Grundfos; "Grundfos SmartFio SQE Constant Pressure System;" Mar. 2003; pp. 1-2; USA.
Grundfos; "Uncomplicated Electronics . . . Advanced Design;" pp. 1-10; Undated.
Grundfos; "CU301 Installation & Operation Manual;" Apr. 2009; pp. 1-2; Undated; www.grundfos.com.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Franklin Electric; "Monodrive MonodriveXT Single-Phase Constant Pressure;" Sep. 2008; pp. 1-2; Bluffton, IN USA.
Docket Report for Case No. 5:11-cv-00459-D; Nov. 2012.
1—Complaint Filed by Pentair Water Pool & Spa, Inc. and Danfoss Drives A/S with respect to Civil Action No. 5:11-cv-00459-D; Aug. 31, 2011.
7—Motion for Preliminary Injunction by Danfoss Drives AIS & Pentair Water Pool & Spa, Inc. with respect to Civil Action No. 5:11-cv-00459-D; Sep. 30, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. in Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answer to Complaint with Jury Demand & Counterclaim Against Plaintiffs by Hayward Pool Products & Hayward Industries for Civil Action 5:11-cv-004590; Oct. 12, 2011.
USPTO Patent Trial and Appeal Board, Paper 47—Final Written Decision, Case IPR2013-00285, U.S. Pat. No. 8,019,479 B2, Nov. 19, 2014, 39 pages.
Pentair Pool Products, WhisperFlo Pump Owner's Manual, Jun. 5, 2001, 10 pages.
51—Response by Defendants in Opposition to Motion for Preliminary Injunction for Civil Action 5:11-cv-00459D; Dec. 2, 2011.
Amended Complaint Filed by Pentair Water Pool & Spa, Inc. and Danfoss Drives A/S with respect to Civil Action No. 5:11-cv-00459, adding U.S. Pat. No. 8,043,070.
53—Declaration of Douglas C. Hopkins & Exhibits re Response Opposing Motion for Preliminary Injunction for Civil Action 5:11-cv-00459D; Dec. 2, 2011.
89—Reply to Response to Motion for Preliminary Injunction Filed by Danfoss Drives A/S & Pentair Water Pool & Spa, Inc. for Civil Action 5:11-cv-004590; Jan. 3, 2012.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—0rder Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. for Civil Action 5:11-cv-00459D; Jan. 27, 2012.

(56) References Cited

OTHER PUBLICATIONS

152—0rder Denying Motion for Reconsideration for Civil Action 5:11-cv-00459D; Apr. 4, 2012.
168—Amended Motion to Stay Action Pending Reexamination of Asserted Patents by Defendants for Civil Action 5:11-cv-004590; Jun. 13, 2012.
174—Notice and Attachments re Joint Claim Construction Statement for Civil Action 5:11-cv-00459D; Jun. 5, 2012.
186—0rder Setting Hearings-Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-004590; Jul. 2012.
210—0rder Granting Joint Motion for Leave to Enlarge Page Limit for Civil Action 5:11-cv-004590; Jul. 2012.
218—Notice re Plaintiffs re Order on Motion for Leave to File Excess Pages re Amended Joint Claim Construction Statement for Civil Action 5:11-cv-004590; Aug. 2012.
54DX16—Hayward EcoStar Technical Guide (Version2); 2011; pp. 1-51; cited in Civil Action 5:11-cv-004590.
54DX17—Hayward ProLogic Automation & Chlorination Operation Manual (Rev. F); pp. 1-27; Elizabeth, NJ; cited in Civil Action 5:11-cv-004590; Dec. 2, 2011.
54DX18—Stmicroelectronics; "AN1946-Sensorless BLOC Motor Control & BEMF Sampling Methods with ST7MC;" 2007; pp. 1-35; Civil Action 5:11-cv-004590.
54DX19—Stmicroelectronics; "AN1276 BLOC Motor Start Routine for ST72141 Microcontroller;" 2000; pp. 1-18; cited in Civil Action 5:11-cv-004590.
54DX21—Danfoss; "VLT 8000 Aqua Instruction Manual;" Apr. 2004; 1-210; Cited in Civil Action 5:11-cv-004590.
54DX22—Danfoss; "VLT 8000 Aqua Instruction Manual;" pp. 1-35; cited in Civil Action 5:11-cv-004590; Dec. 2, 2011.
54DX23—Commander; "Commander SE Advanced User Guide;" Nov. 2002; pp. 1-190; cited in Civil Action 5:11-cv-004590.
540X30—Sabbagh et al.; "A Model for OptimaL.Control of Pumping Stations in Irrigation Systems;" Jul. 1988; NL pp. 119-133; Civil Action 5:11-cv-004590.
540X31—0anfoss; "VLT 5000 FLUX Aqua OeviceNet Instruction Manual;" Apr. 28, 2003; pp. 1-39; cited in Civil Action 5:11-cv-004590.
540X32—0anfoss; "VLT 5000 FLUX Aqua Profibus Operating Instructions;" May 22, 2003; 1-64; cited in Civil Action 5:11-cv-004590.
540X33—Pentair; "IntelliTouch Owner's Manual Set-Up & Programming;" May 22, 2003; Sanford, NC; pp. 1-61; cited in Civil Action 5:11-cv-004590.
540X34—Pentair; "Compoo13800 Pool-Spa Control System Installation & Operating Instructions;" Nov. 7, 1997; pp. 1-45; cited in Civil Action 5:11-cv-004590.
540X35—Pentair Advertisement in "Pool & Spa News;" Mar. 22, 2002; pp. 1-3; cited in Civil Action 5:11-cv-004590.
5540X36—Hayward; "Pro-Series High-Rate Sand Filter Owner's Guide;" 2002; Elizabeth, NJ; pp. 1-5; cited in Civil Action 5:11-cv-00459D.
540X37—Danfoss; "VLT 8000 Aqua Fact Sheet;" Jan. 2002; pp. 1-3; cited in Civil Action 5:11-cv-004590.
540X38—0anfoss; "VLT 6000 Series Installation, Operation & Maintenance Manual;" Mar. 2000; pp. 1-118; cited in civil Action 5:11-cv-004590.
540X45—Hopkins; "Synthesis of New Class of Converters that Utilize Energy Recirculation;" pp. 1-7; cited in Civil Action 5:11-cv-004590; 1994.
540X46—Hopkins; "High-Temperature, High-Oensity . . . Embedded Operation;" pp. 1-8; cited in Civil Action 5:11-cv-004590; Mar. 2006.
540X47—Hopkins; "Optimally Selecting Packaging Technologies . . . Cost & Performance;" pp. 1-9; cited in Civil Action 5:11-cv-004590; Jun. 1999.
9PX5—Pentair; Selected Website Pages; pp. 1-29; cited in Civil Action 5:11-cv-004590; Sep. 2011.
9PX6—Pentair; "IntelliFio Variable Speed Pump" Brochure; 2011; pp. 1-9; cited in Civil Action 5:11-cv-004590.
9PX7—Pentair; "IntelliFio VF Intelligent Variable Flow Pump;" 2011; pp. 1-9; cited in Civil Action 5:11-cv-004590.
9PX8—Pentair; "IntelliFio VS+SVRS Intelligent Variable Speed Pump;" 2011; pp. 1-9; cited in Civil Action 5:11-cv-004590.
9PX9—STA-RITE; "IntelliPro Variable Speed Pump;" 2011; pp. 1-9; cited in Civil Action 5:11-cv-004590.
9PX14—Pentair; "IntelliFio Installation and User's Guide;" pp. 1-53; Jul. 26, 2011; Sanford, NC; cited in Civil Action 5:11-cv-004590.
9PX16—Hayward Pool Products; "EcoStar Owner's Manual (Rev. B);" pp. 1-32; Elizabeth, NJ; cited in civil Action 5:11-cv-00459D; 2010.
9PX17—Hayward Pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products;"Hayward Energy Solutions Brochure;" pp. 1-3; www.haywardnet.com; cited in Civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX22—Hayward Pool Products; "Wireless & Wired Remote Controls Brochure;" pp. 1-5; 2010; Elizabeth, NJ; cited in Civil Action 5:11-cv-00459D.
9PX23—Hayward Pool Products; Selected Pages from Hayward's Website:/www.hayward-pool.com; pp. 1-27; cited in Civil Action 5:11-cv-004590; Sep. 2011.
9PX28—Hayward Pool Products; "Selected Page from Hayward's Website Relating to EcoStar Pumps;" p. 1; cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to ProLogic Controllers;" pp. 1-5; Civil Action 5:11-cv-00459D; Sep. 2011.
Flotec Owner's Manual, dated 2004. 44 pages.
Glentronics Home Page, dated 2007. 2 pages.
Goulds Pumps SPBB Battery Back-Up Pump Brochure, dated 2008. 2 pages.
Goulds Pumps SPBB/SPBB2 Battery Backup Sump Pumps, dated 2007.
ITT Red Jacket Water Products Installation, Operation and Parts Manual, dated 2009. 8 pages.
Liberty Pumps PC-Series Brochure, dated 2010. 2 pages.
"Lift Station Level Control" by Joe Evans PhD, www.pumped101.com, dated Sep. 2007. 5 pages.
The Basement Watchdog A/C—D/C Battery Backup Sump Pump System Instruction Manual and Safety Warnings, dated 2010. 20 pages.
The Basement Watchdog Computer Controlled A/C—D/C Sump Pump System Instruction Manual, dated 2010. 17 pages.
Pentair Water Ace Pump Catalog, dated 2007, 44 pages.
ITT Red Jacket Water Products RJBB/RJBB2 Battery Backup Sump Pumps; May 2007, 2 pages.
U.S. Patent Trial and Appeal Board's Rule 36 Judgment, without opinion, in Case No. 2016-2598, dated Aug. 15, 2017, pp. 1-2.

* cited by examiner

ANTI-ENTRAPMENT AND ANTI-DEADHEAD FUNCTION

RELATED APPLICATIONS

This application is a continuation of U.S. application Ser. No. 14/097,101 filed Dec. 4, 2013, which is a continuation of U.S. application Ser. No. 11/609,057 filed Dec. 11, 2006, which is a continuation-in-part of U.S. application Ser. No. 10/926,513 filed Aug. 26, 2004 and U.S. application Ser. No. 11/286,888 filed Nov. 23, 2005, the entire disclosures of which are hereby incorporated by reference.

FIELD OF THE INVENTION

The present invention relates generally to control of a pump, and more particularly to control of a variable speed pumping system for a pool, a spa, or other aquatic application.

BACKGROUND OF THE INVENTION

Conventionally, a pump to be used in an aquatic application such as a pool or a spa is operable at a finite number of predetermined speed settings (e.g., typically high and low settings). Typically, these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the aquatic application conditions and/or pumping demands.

Generally, pumps of this type are often operated in a non-supervised manner. However, a number of problems can develop in the aquatic application that can pose a risk to damage of the pump and/or even injury to a user (i.e., a swimmer) of the aquatic application. Examples of these problems can include a deadhead condition and an entrapment condition. In one example, a deadhead condition can be caused by an obstruction or the like in the plumbing downstream from the pump. The obstruction can be caused by various reasons, such as sedimentary build-up that occurs over time, a foreign object that is lodged in the plumbing, or a valve that has been inadvertently closed. The obstruction can cause damage to the pumping system, such as by a "water hammer" effect and/or by excessive loading of the pumping system. In another example, entrapment can occur when part of a user's body becomes attached to a suction drain (e.g., pool drains, skimmers, equalizer fittings, vacuum fittings and/or intakes for water features, such a fountains, slides or the like) because of the powerful suction of the pumping system. Though most pools and spas include suction drain grates, the grates can be loose, missing, and/or damaged over time. Thus, when a user stands or sits on the loose, missing or damaged drain grate, the suction from the pumping system can hold the user underwater and can cause drowning or other injuries.

Accordingly, it would be beneficial to provide a pump that could be readily and easily adapted to respond to a deadhead and/or entrapment condition to protect the users and/or the pumping system. Further, the pumping system should be responsive to a change of conditions and/or user input instructions.

SUMMARY OF THE INVENTION

In accordance with one aspect, the present disclosure provides a method of controlling a pumping system for at least one aquatic application having a pump driven by a motor coupled to the pump. The method includes the steps of determining, via a controller in communication with the motor, whether a blockage condition exists based on a power consumption value of the motor. The blockage condition is at least one of an entrapment condition and a deadhead condition. If a blockage condition is detected, the method further includes the steps of restarting the pump after detection of the blockage condition, undertaking a fast detection method in response to the entrapment condition, wherein the controller is alerted upon a first occurrence of a blockage event, or undertaking a slow detection method in response to the deadhead condition, wherein the controller is alerted upon a plurality of blockage events.

In accordance with another aspect, the present disclosure provides a method for controlling a pumping system for at least one aquatic application having a pump coupled to a motor. The method includes the steps of determining, via a controller in communication with the motor, whether a blockage condition exists by comparing a current power consumption value of the motor to one of, a baseline value of power consumption of the motor, or a previous power consumption value of the motor, performing a condition check to determine whether a speed of the motor has recently changed, shutting down the pumping system based on the comparison of the current power consumption value if the speed change did not occur during a transition or a stabilization stage of the speed change, and calculating a power gradient baseline value based on the change in speed and corresponding oscillations in power consumption of the motor if the speed has recently changed.

In accordance with still another aspect, the present disclosure provides a method for controlling a pumping system having a pump that is coupled with a motor, comprising the steps of establishing, via a controller in communication with the motor, a baseline value of power consumption of the motor during a deadhead condition; determining, via the controller, a current value of Power consumption of the motor, increasing a counter, via the controller, when the current value decreases below the baseline value, and determining, via the controller, a deadhead condition caused by a blockage downstream from the pump when the counter exceeds a limit.

In accordance with another aspect, the present disclosure provides a method of operating a pumping system for at least one aquatic application having a pump being electrically coupled with a motor. The method includes the steps of comparing, via a controller in electrical communication with the motor, a current power consumption value of the motor to a substantially immediately previous power consumption value of the motor to determine a difference value, shutting down the motor, via the controller, substantially immediately if the difference value indicates a sudden decrease in power consumption of the motor occurring during an entrapment condition caused by a blockage on a suction side of the pump, performing a condition check, via the controller, to determine whether a speed of the motor has recently changed before shutting down the motor due to torque ripple, and calculating a power gradient baseline value, via the controller, based on the change in speed.

In accordance with another aspect, the present disclosure provides a method of operating a pumping system for at least one aquatic application having a pump that is operatively coupled with a motor. The method includes the steps of comparing, via a controller in communication with the motor, a current power consumption value of the motor to a substantially immediately previous power consumption value of the motor to determine a difference value, shutting down the motor, via the controller, substantially immediately if the difference value indicates a sudden decrease in power consumption of the motor during an entrapment condition caused by a blockage on a suction side of the pump, and performing a condition check, via the controller, to determine whether a speed of the motor has recently changed before shutting down the motor in order to avoid shutting down the motor due to torque ripple. If the speed has not recently changed, the controller calculates a power gradient baseline value based on a percentage of a present power consumption of the motor.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
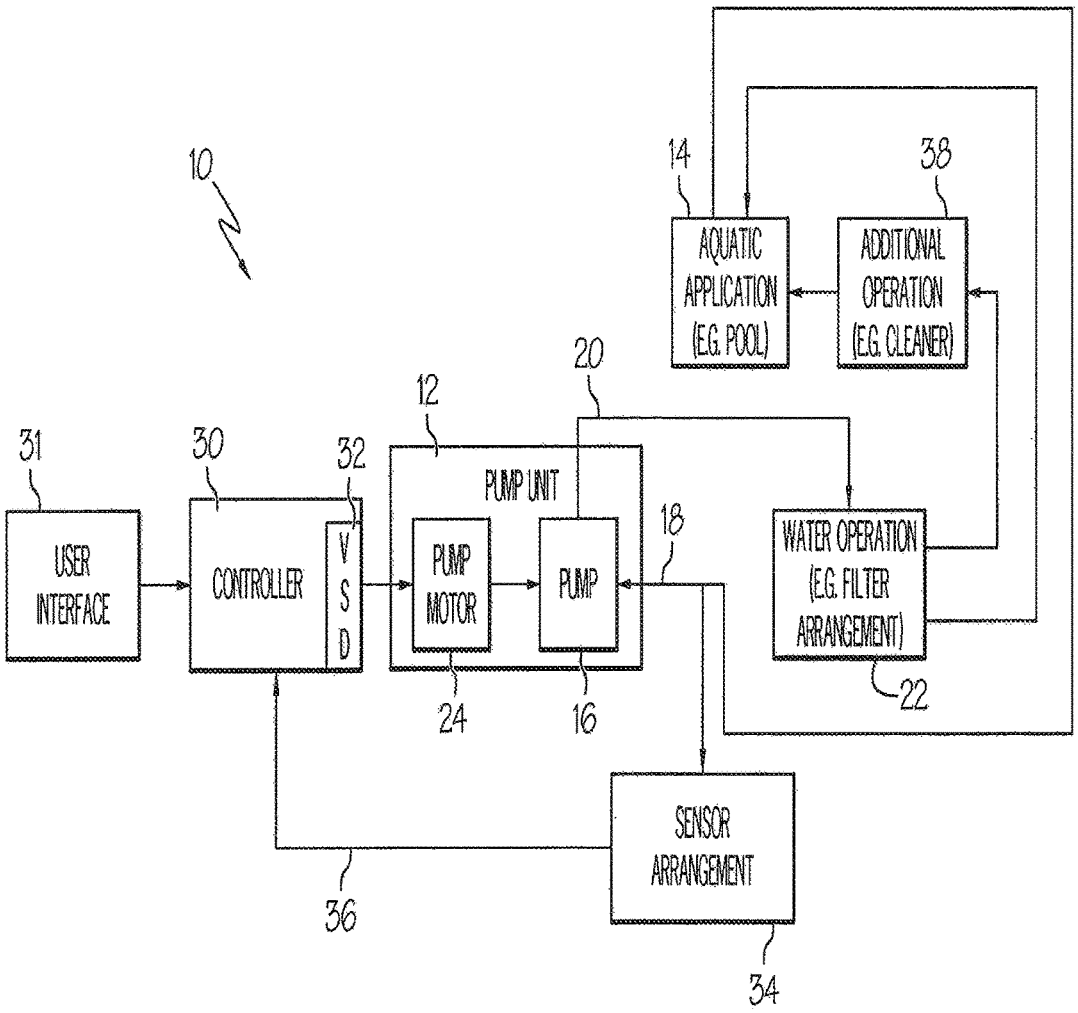
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex, or diverse. For example, the operation performed on the water may merely be just movement of the water by the pumping system (e.g., recirculation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or an asynchronous motor. The pump motor 24 operation is infinitely variable within a range of operation (i.e., zero to maximum operation). In one specific example, the operation is indicated by the RPM of the rotational force provided to rotate the impeller of the pump 16. Thus, either or both of the pump 16 and/or the motor 24 can be configured to consume power during operation.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit. Further still, the controller 30 can receive input from a user interface 31 that can be operatively connected to the controller in various manners.

The pumping system 10 has means used for control of the operation of the pump. In accordance with one aspect of the present invention, the pumping system 10 includes means for sensing, determining, or the like one or more parameters or performance values indicative of the operation performed upon the water. Within one specific example, the system includes means for sensing, determining or the like one or more parameters or performance values indicative of the movement of water within the fluid circuit.

The ability to sense, determine or the like one or more parameters or performance values may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 can include at least one sensor used to determine a flow rate of the water moving within the fluid circuit and/or includes at least one sensor used to determine a flow pressure of the water moving within the fluid circuit. In one example, the sensor arrangement 34 can be operatively connected with the water circuit adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto. Further still, one or more sensor arrangement(s) 34 can be used to sense parameters or performance values of other components, such as the motor (e.g., motor speed or power consumption) or even values within program data running within the controller 30.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the aquatic application to the pump such as debris accumulation or the lack of accumulation, within the filter arrangement 34. As such, the monitored information is indicative of the condition of the filter arrangement.

Figure 2:
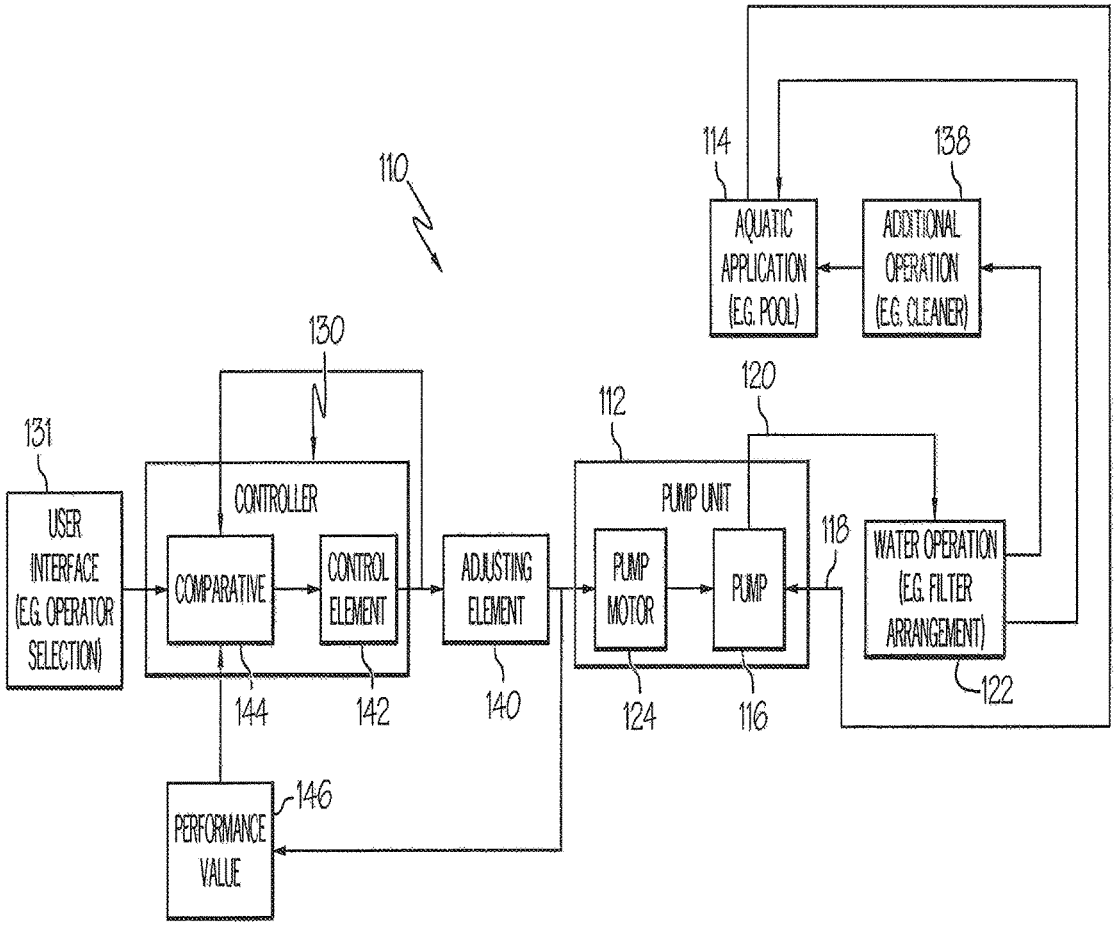
FIG. 2 is another block diagram of another example of a variable speed pumping system in accordance with the present invention with a pool environment.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such additional water movement may be used to supplant the need for other water movement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the controller 130 can receive input from a user interface 131 that can be operatively connected to the controller in various manners.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter or performance value is power consumption. Pressure and/or flow rate can be calculated/determined from such pump parameter(s).

Although the system 110 and the controller 130 may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from a performance value 146.

The performance value 146 can be determined utilizing information from the operation of the pump motor 124 and controlled by the adjusting element 140. As such, a feedback iteration can be performed to control the pump motor 124. Also, operation of the pump motor and the pump can provide the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine the various performance characteristics of the pumping system 110, such as input power consumed, motor speed, flow rate, and/or the flow pressure. In one example, the operation can be configured to prevent damage to a user or to the pumping system 10, 110 caused by an obstruction, such as a deadhead or entrapment condition. Thus, the controller (e.g., 30 or 130) provides the control to operate the pump motor/pump accordingly. In other words, the controller (e.g., 30 or 130) can repeatedly monitor one or more performance value(s) 146 of the pumping system 10,110, such as the input power consumed by, or the speed of, the pump motor (e.g., 24 or 124) to sense or determine a parameter a parameter indicative of a blockage.

Turning to one aspect that is provided by the present invention, the system (e.g., 10 or 110) can operate to alter operation of the pump in response to a determination of a blockage. Within another aspect of the present invention, the system (e.g., 10 or 110) can operate to control the motor in repose to a comparison between a performance value 146 and a value indicative of a blockage. Within yet another aspect of the present invention, the system 10, 110 can alter operation of the pump when a performance value 146 exceeds a threshold value. In still yet another aspect of the present invention, the system 10, 110 can control the pump in response to a comparison of a plurality of performance values 146.

It is to be appreciated that although similar methodology can be used to detect various blockage conditions within an aquatic application, such as deadhead and entrapment conditions, it can be beneficial to have different detection methods for each blockage condition to be detected. For example, it is desirable to relatively quickly detect and/or react to an entrapment condition to protect a user and/or the pumping system. Conversely, it can be desirable to relatively slowly detect and/or react to a dead-head condition that can be caused by sedimentary blockage over a lengthy period of time. Thus, as used herein, a "fast detection" method refers to situations involving relatively quick detection and/or reaction to a blockage an entrapment condition or the like), while a "slow detection" method refers to situations involving relatively slow detection and/or reaction to a blockage (i.e., a deadhead condition). In one example, a "fast detection" method can alert the system upon a first occurrence of an event (i.e., the first detection of a blockage, such as an entrapment condition), while a "slow detection" method can alert the system only upon a number of cumulative or consecutive occurrences (i.e., upon a pre-determined number of blockage detections, such as sedimentary build-up over time).

Figure 3A:
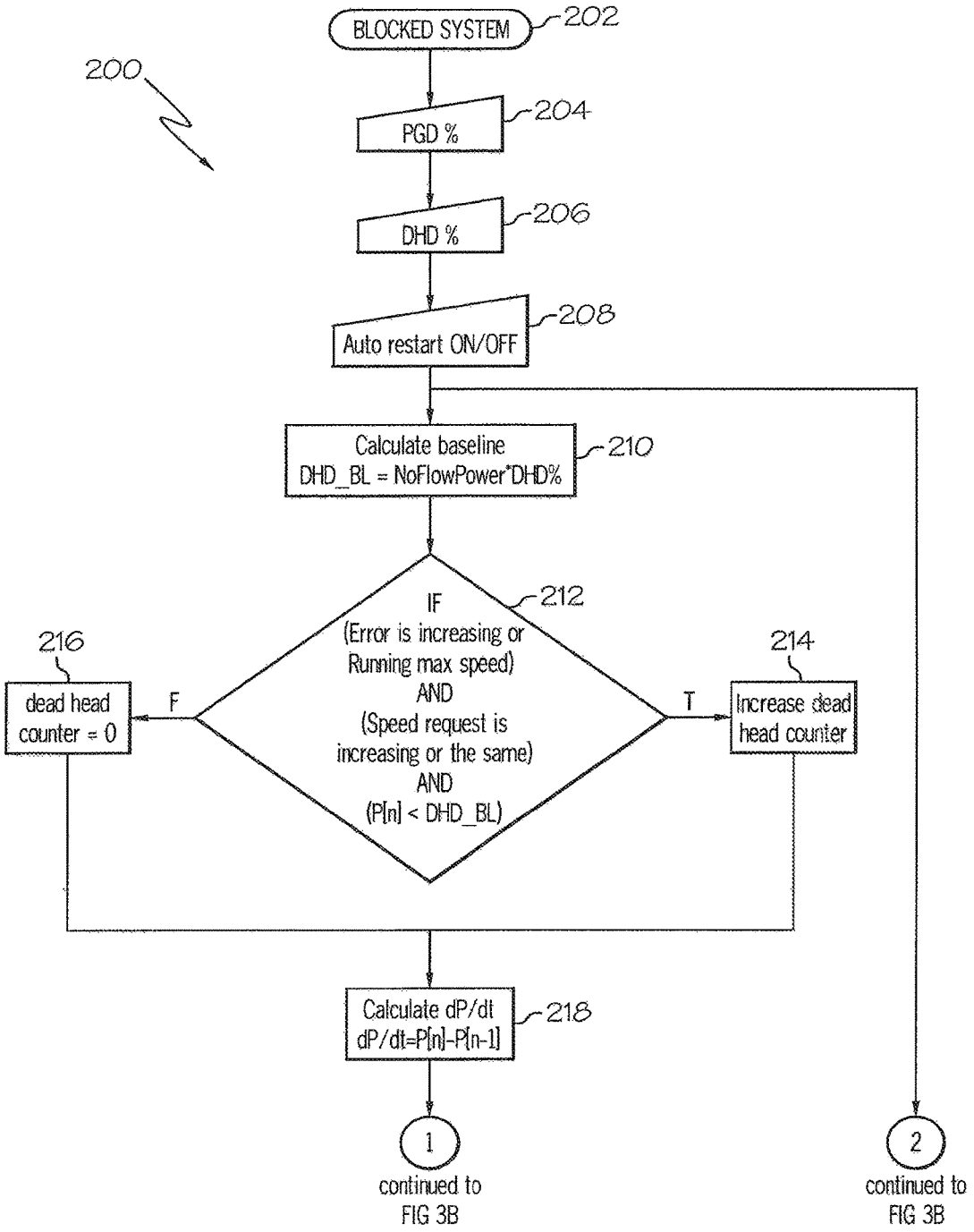
FIGS. 3A and 3B are a flow chart for an example of a process in accordance with an aspect of the present invention.
Figure 3B:
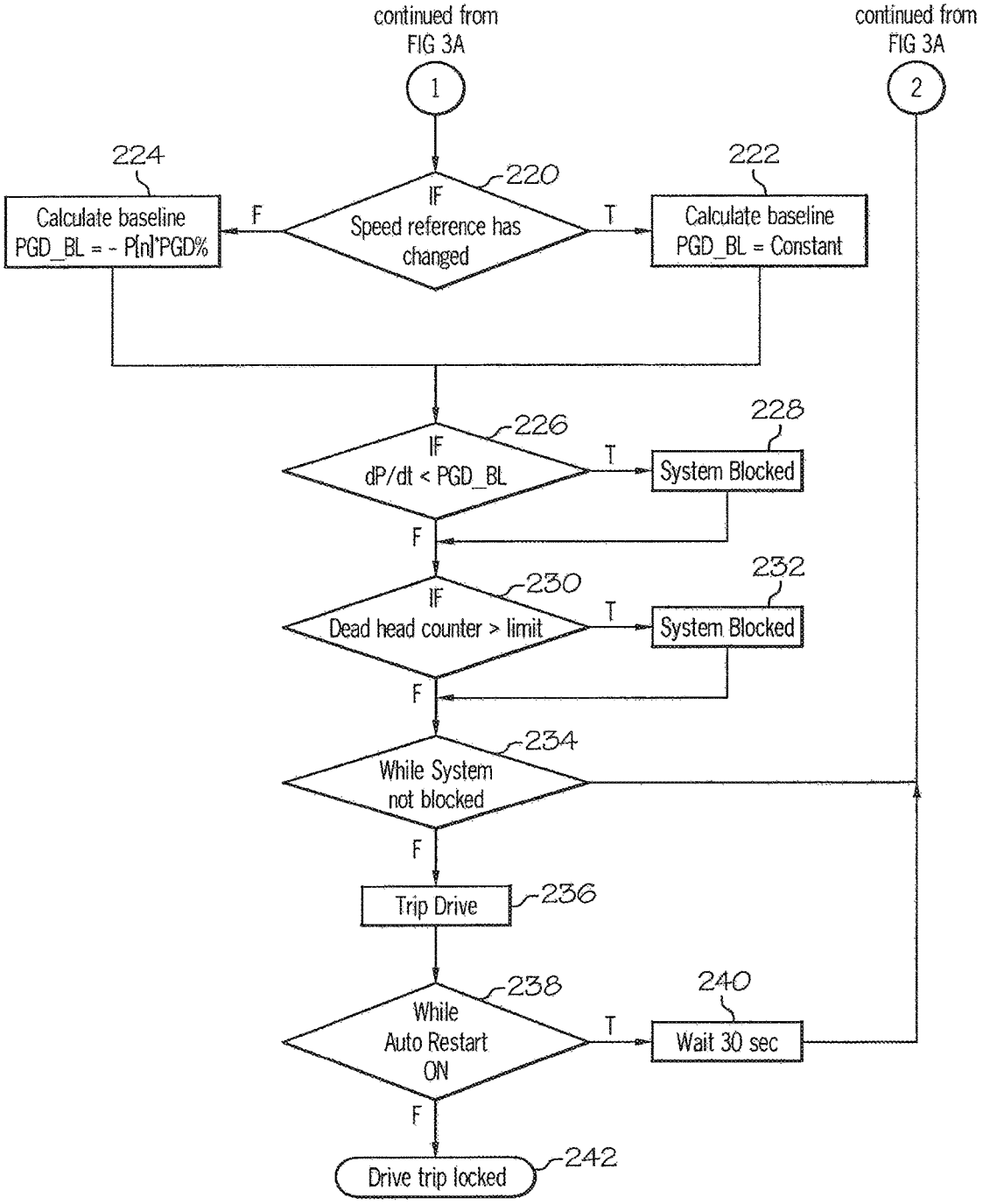

Turning to one specific example, attention is directed to the process chart that is shown in FIGS. 3A and 3B. It is to be appreciated that the process chart as shown is intended to be only one example method of operation, and that more or less steps can be included in various orders. For the sake of clarity, the example process described below can determine a blockage in the system based on a detection of a performance value, such as a change in the power consumption of the pump unit 12,112 and/or the pump motor 24, 124, though it is to be appreciated that various other performance values (i.e., motor speed, flow rate and/or flow pressure of water moved by the pump unit 12, 112, or the like) can also be used for blockage detection (e.g., through either direct or indirect measurement and/or determination). For example, when a blockage is present in a pumping system 10, 110 of an aquatic application of the type described herein, the power consumed by the pump unit 12,112 and/or pump motor 24, 124 can decrease. Thus, a blockage can be detected upon a determination of a decrease in power consumption and/or associated other performance values (e.g., relative amount of decrease, comparison of decreased values, time elapsed, number of consecutive decreases, etc.). The change in power consumption can be determined in various ways. In one example, the change in power consumption can be based upon a measurement of electrical current and electrical voltage provided to the motor 24, 124. Various other factors can also be included such as the power factor, resistance, and/or friction of the motor 24, 124 components, and/or even physical properties of the aquatic application, such as the temperature of the water. In addition or alternatively, when a blockage is present in the pumping system 10, 110, the flow rate of the water moved by the pump unit 12, 112 and/or pump motor 24, 124 can also decrease, and a blocked system can also be determined from a detection of the decreased flow rate.

The process 200 is initiated at step 202, which is merely a title block, and proceeds to step 204. At steps 204 and 206, information can be retrieved from a filter menu such as the user interface 31, 131. The information may take a variety of forms and may have a variety of contents. As one example, the information can include user inputs related to the sensitivity of the system for detecting a system blockage. Thus, a user can make the system more or less sensitive to various blockage conditions, such as the aforementioned entrapment and/or deadhead conditions, and can even change the sensitivity to each blockage condition individually. In addition or alternatively, the information of steps 204 and 206 can be calculated or otherwise determined (e.g., stored in memory or found in a look-up table, graph, curve or the like). The information of steps 204 and 206 can include various forms, such as a value (e.g., "Yes" or "No", a numerical value, or even a numerical value within a range of values) or a percentage (e.g., for determining a percentage change in the determined and/or measured performance values of the system 10, 110). It should be appreciated that such information (e.g., values, percentages, etc.) is desired and/or intended, and/or preselected/predetermined.

Subsequent to step 206, the process 200 can proceed to step 208 where even further information can be retrieved from a filter menu or the like (e.g., user interface 31, 131). In one example, the additional information can relate to an "auto restart" feature that can be adapted to permit the pumping system 10, 110 to automatically restart in the event that it has been slowed and/or shut down due to the detection of a blockage (e.g., entrapment or deadhead condition). As before, the information of step 208 can include various forms, such as a value (e.g., 0 or 1, or "yes" or "no"), though it can even comprise a physical switch or the like. It is to be appreciated that various other information can be input by a user to alter control of the blockage detection system.

Subsequent to step 208, the process 200 can proceed to step 210. As shown by FIGS. 3A and 3B, steps 210 and further can be contained within a constantly repeating loop, such as a "while" loop, "if-then" loop, or the like, as is well known in the art. In one example, the "while" or "if-then" loop can cycle at predetermined intervals, such as once every 100 milliseconds. Further, it is to be appreciated that the loop can include various methods of breaking out of the loop due to various conditions and/or user inputs. In one example, the loop could be broken (and the program restarted) if a blockage is detected or if the user changed the input values of steps 204, 206, or 208.

In step 210, the process 200 can determine a value indicative of a blockage that inhibits the movement of water through the pumping system 10, 110. In one example, step 210 can determine (e.g., calculate, get from memory or a look-up table, graph, curve etc.) a baseline value for detection of a deadhead condition (i.e., slow detection). As shown in FIG. 3A, the baseline value can be calculated as a percentage of a known value, such as the power consumption of the pump unit 12, 112 and/or the pump motor 24, 124. Thus, for example, the baseline value can be calculated as a percentage of a "No Flow" power value, or the power consumed by the pump motor 24, 124 during a complete blockage of the downstream plumbing. The "No Flow" power value can be a constant, or, in the case of a variable speed drive, can be dependent upon other values, such as the current speed (RPM) of the motor 24, 124. Additionally, the baseline value can also be dependent upon a value obtained the user interface 31, 131, such as the percentage value obtained in step 206. Thus, as shown, the deadhead baseline value can be calculated as a percentage (DHD %) of the "No Flow" power value of the current motor running speed.

Subsequent to step 210, the process 200 can proceed to step 212 to determine whether a deadhead condition exists (i.e., slow detection). Thus, the process 200 can be configured in step 212 to make a comparison between a performance value and the previously-determined value indicative of a blockage. In one example, the current power (P[n]) consumed by the pump unit 12, 112 and/or the pump motor 24, 124 can be compared to the previously determined baseline value (DHD_BL). Thus, as shown, step 212 can be in the form of an "if-then" comparison such that if the current power consumption (P[n]) is less than or greater than the previously determined baseline value (DHD_BL), step 212 can output a true or false parameter, respectively.

As stated previously, "slow detection" (i.e., deadhead detection) can require a number of occurrences (blockage detections) before triggering the system. Thus, as shown, in the event of a true parameter output (i.e., the present power consumption is less than the baseline value, or P[n]<DHD_BL), the process 200 can proceed onto step 214 whereby a means for counting can increase a counter or the like, such as by increasing a counter by a value of +1. Similarly, in the event of a false parameter output (i.e., P[n]>DHD_BL), the process 200 can proceed onto step 216 whereby the means for counting can decrease or reset a counter or the like, such as by decreasing the counter by a value of −1 or resetting the counter to 0. Thus, it is to be appreciated that such a counter value can comprise a second performance value and a predetermined number of occurrences can comprise a second threshold value of the pumping system 10, 110.

It is also to be appreciated that while the means for counting can be configured to count a discrete number of occurrences (e.g., 1, 2, 3), it can also be configured to monitor and/or react to non-discrete trends in data. For example, instead of counting a discrete number of consecutive occurrences of an event, the means for counting could be configured to monitor an increasing or decreasing performance value and to react when the performance value exceeds a particular threshold. In addition or alternatively, the means for counting can be configured to monitor and/or react to various changes in a performance value with respect to another value, such as time, another performance value, another value indicative of a blockage, or the like.

In addition or alternatively, the determination of a deadhead condition as shown in step 212 can also include various other "if-then" statements or the like. For example, as shown, three separate "if-then" sub-statements must be true in order for the entire "if-then" statement to be true. Step 212 can include various sub-statements related to various other parameters that can be indicative of a slowly blocked system. For example, the sub-statements can include a comparison of changes to various other performance values, such as other aspects of power, motor speed, flow rate, and/or flow pressure. In one example, as shown, the first sub-statement can make a comparison of a power error determination in the controller 30, 130 and/or a comparison of the current motor speed compared to predetermined maximum and minimum operating values. In another example, the second sub-statement can make a comparison between the current and previous motor speeds, and can even make a determination as to whether a speed change was recently ordered by a user or by the controller 30, 130 that could affect the power consumed by the motor 24, 124. Various numbers and types of sub-statements can be used depending upon the particular system. Further still, the determination of step 212 can be configured to interact with (i.e., send or receive information to or from) a second means for controlling the pump. The second means for controlling the pump can include various other elements, such as a separate controller, a manual control system, and/or even a separate program running within the first controller 30, 130. The second means for controlling the pump can provide information for the various sub-statements as described above. For example, the information provided can include motor speed, power consumption, flow rate or flow pressure, or any changes therein, or even any changes in additional features cycles of the pumping system 10, 110 or the like.

Subsequent to steps 214 and 216, the process 200 can proceed onto step 218 to determine whether an entrapment condition exists (i.e., fast detection or "power gradient detection"). In one example, the current power (P[n]) consumed by the pump unit 12, 112 and/or the pump motor 24, 124 can be compared to a previously determined power consumption (P[n−1]) thereof. Thus, the current power (P[n]) consumption can be compared against the previous power consumption (P [n−1]) of a previous program or time cycle (i.e., the power consumption determination made during the preceding program or time cycle that occurred 100 milliseconds prior). As shown, the change in power consumption (dP/dt) between a first time period and a second time period can comprise a difference value that can include subtracting the previous power consumption (P[n−1]) from the present power consumption (P[n]), though various other comparisons, including other parameters, can also be used. Thus, when there is a sudden decrease in power consumption as compared between program time cycles (i.e., between the first and second time periods), such as might occur in an entrapment condition if a person or other object became lodged against an input 18, 118 to the pump 16, 116, the process 200 can quickly detect the blockage condition and react appropriately.

Subsequent to step 218, the process proceeds to step 220 (see FIG. 3B). As stated previously, a "fast detection" blockage indication can be made when a sudden decrease in power consumption is observed. However, it is to be appreciated that in a pump system 10, 110 for use with an aquatic application 14, 114 as described herein, power consumption by the pump unit 12, 112 and/or pump motor 24, 124 is dependent upon the speed of the motor. Thus, a change in the motor speed can result in a corresponding change in power consumption by the pump motor 24, 124 regardless of any other conditions, such as a blockage condition that may or may not exist. Further, during a motor speed change, torque ripple or the like from the motor 24, 124 can influence power consumption determinations and may even cause oscillations in the power consumption during the transition and settling/stabilization stages of the speed change. Thus, the process 200 can include a condition check at step 220 to determine whether the motor speed has recently changed, and can correspondingly alter the sensitivity of the blocked system "fast" detection baseline.

In one example, as shown in step 220, if the motor speed has recently changed, the process 200 can determine a baseline value (i.e., a value indicative of a blockage) based upon the motor speed change and corresponding oscillations in power consumption. Thus, as shown in step 222, when the motor speed has recently changed, the baseline value (PGD_BL) can be based on a fixed trigger value, such as a constant, a value from a look-up table, graph, curve, or the like. For example, the baseline value can be based on a predetermined constant that can provide a trigger level capable of preventing erroneous triggering of a blocked system detection during the speed change transition and settling times, while still permitting blocked system detection in the event of severe power gradient changes caused by an actual entrapment condition.

In another example, as shown in step 224, if the motor speed has not recently changed, the process 200 can determine a baseline value (PGD_BL) based upon (i.e., calculated) a percentage of a the present power consumption (P[n]) of the pump unit 12, 112 and/or the motor 24, 124. Additionally, the baseline value can also be dependent upon a value obtained via the user interface 31, 131, such as the percentage value obtained in step 204. Thus, as shown, the power gradient (i.e., "fast detection") baseline value can be calculated as a percentage (PGD %) of the present power consumption (P[n]). Thus, for example, if the present change in power consumption (P[n]) exceeds a percentage of the present power consumption (P[n]), then a blocked system condition can be triggered.

Subsequent to steps 222 and 224, the process 200 can make a final determination of whether the pumping system 10, 110 is actually blocked. First, the process 200 can determine whether an entrapment condition exists ("fast detection"). In step 226, the process 200 can compare the change in power consumption (dP/dt) to the power gradient baseline (PGD_BL). Thus, as shown, step 226 can be in the form of an "if-then" comparison such that if the change in power consumption (difference value dP/dt) is less than or greater than the previously determined baseline value (PGD_BL), step 226 can output a true or false parameter, respectively. Thus, as shown, in the event of a true parameter output (i.e., dP/dt<PGD_BL), the process 200 can proceed onto step 228 to indicate that the system is blocked. Conversely, in the event of a false parameter output (i.e., dP/dt>PGD_BL), then the system can proceed onto step 230.

During step 230, the process 200 can determine whether a deadhead condition exists ("slow detection"). In step 230, the process 200 can compare the deadhead counter to a threshold value, such as a predetermined limit, that can comprise a value indicative of a blockage. Thus, as shown, step 230 can also be in the form of an "if-then" comparison such that if the current counter value or the like is less than or greater than the previously determined threshold value, step 230 can output a true or false parameter, respectively. Thus, as shown, in the event of a true parameter output (i.e., counter>threshold), the process 200 can proceed onto step 232 to indicate that the system is blocked. Conversely, in the event of a false parameter output (i.e., counter<threshold), then the system can proceed onto step 234. It is to be appreciated that the "system blocked" steps 228, 232 can output the same, similar, or different values indicative of a blocked system.

Subsequent to step 232, the process 200 proceeds onto step 234. As previously described, the process 200 can exist within a repeating "while" or "if-then" loop or the like. Thus, in step 234, a "while" loop operator can determine whether the system is blocked or not (in response to steps 232 and 234). In the event the system is not blocked, the "while" loop step 234 can cause the process 200 to repeat (see FIG. 3A). However, in the event that a "system blocked" condition is indicated by steps 228 and/or 232, the "while" loop can be broken and the process 200 can proceed onto step 236. In step 236, the process 200 can alter the control of the pump unit 12, 112 and/or the motor 24, 124. In one example, step 236 can be configured to stop the pump unit 12, 112 and/or the motor 24, 124. In another example, the step 236 can vary the speed of the pump unit 12, 112 and/or the motor 24, 124, such as by slowing it down or speeding it up. In addition or alternatively, the process 200 can also be configured to display a visual indication of a blocked system. For example, the process can display a text message such as "Alarm: System Blocked" on a display, such as an LCD display, or it can cause an alarm light, buzzer, or the like to be activated to alert a user to the blockage.

Subsequent to step 236, the process can proceed to either step 238 or 242. In a first example, the process 200 can proceed directly to step 242 to lockout the pump unit 12, 112 and/or the motor 24, 124. The lockout step 242 can inhibit and/or prevent the pump unit 12, 112 and/or the motor 24, 124 from restarting until a user takes specific action. For example, the user can be required to manually restart the pump unit 12, 112 and/or the motor 24, 124 via the user interface 31, 131, or to take other actions.

In another example, the process 200 can proceed to a second "while" loop or the like in step 238, such as that of the previously mentioned "auto-restart" mechanism (see step 208), that can be configured to automatically restart the pump unit 12, 112 and/or the motor 24, 124 after it has been stopped by an indication of a blocked system. If the "auto restart" mechanism has been activated in step 208, then the process 200 can proceed to the "while" loop of step 238 to automatically restart the pump unit 12, 112 and/or the motor 24, 124. The process 200 can also include a time delay as shown in step 240 to permit the pumping system 10, 110 a brief reprieve before the pump unit 12, 112 and/or the motor 24, 124 is restarted. As shown, the delay can be 30 seconds, though various other times are also contemplated to be within the scope of the invention. The delay time can be fixed or can be changed via the user interface 31, 131. Further, though not shown, the "auto restart" loop can also include a counter mechanism or the like to prevent the "auto restart" loop from constantly repeating in the event that the pumping system 10, 110 remains blocked after several failed restart attempts. Finally, in the event that the restart counter is exceeded or the auto-restart feature is disabled, the process 200 can proceed to step 242 to lockout the pump unit 12, 112 and/or the motor 24, 124. It is to be appreciated that the foregoing description of the blockage detection process 200 is not intended to provide a limitation upon the present invention, and as such the process 200 can include more or less steps and/or methodologies.

It is also to be appreciated that the controller (e.g., 30 or 130) may have various forms to accomplish the desired functions. In one example, controller 30 can include a computer processor that operates a program. In the alternative, the program may be considered to be an algorithm. The program may be in the form of macros. Further, the program may be changeable, and the controller 30, 130 is thus programmable.

Figure 4:
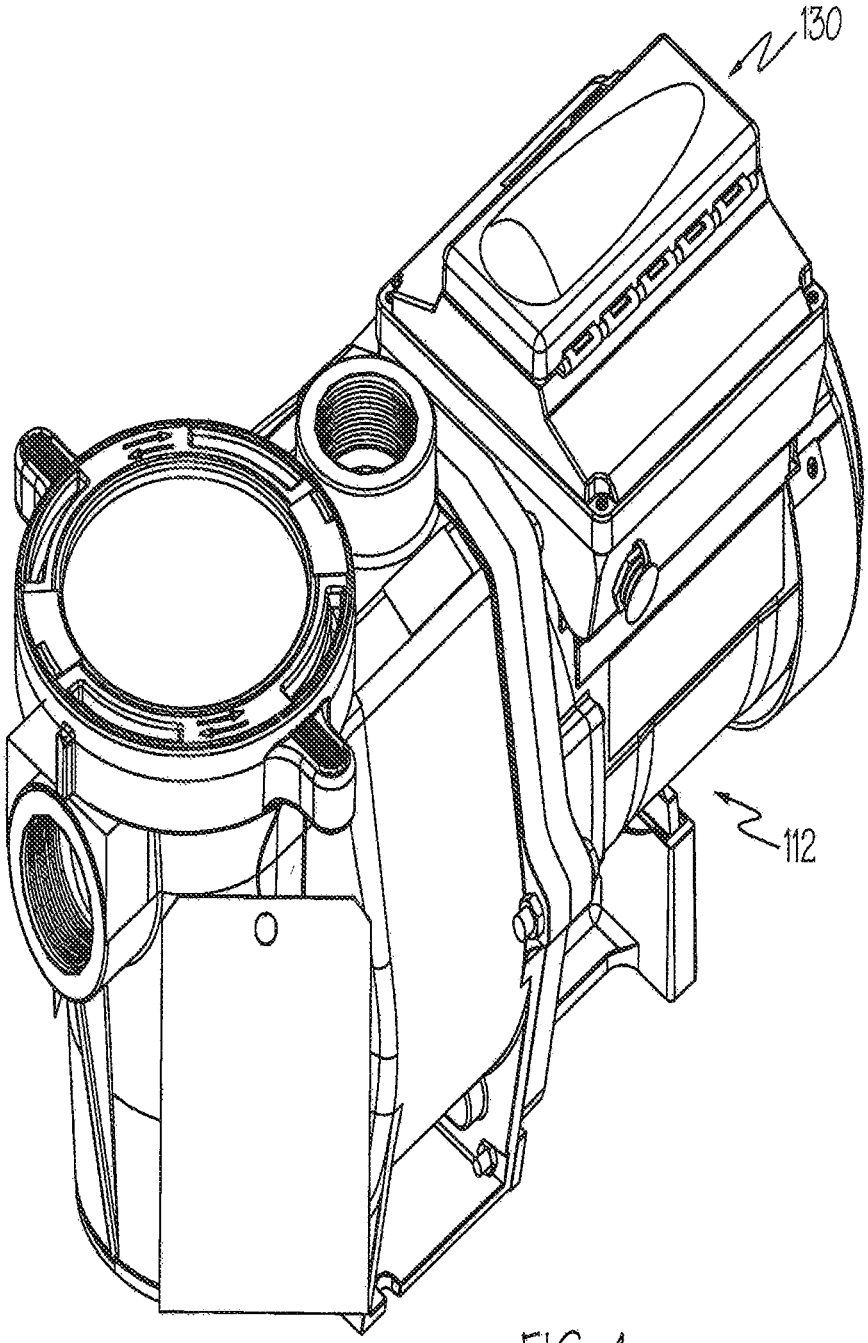
FIG. 4 is a perceptive view of an example pump unit that incorporates the present invention.
Figure 5:
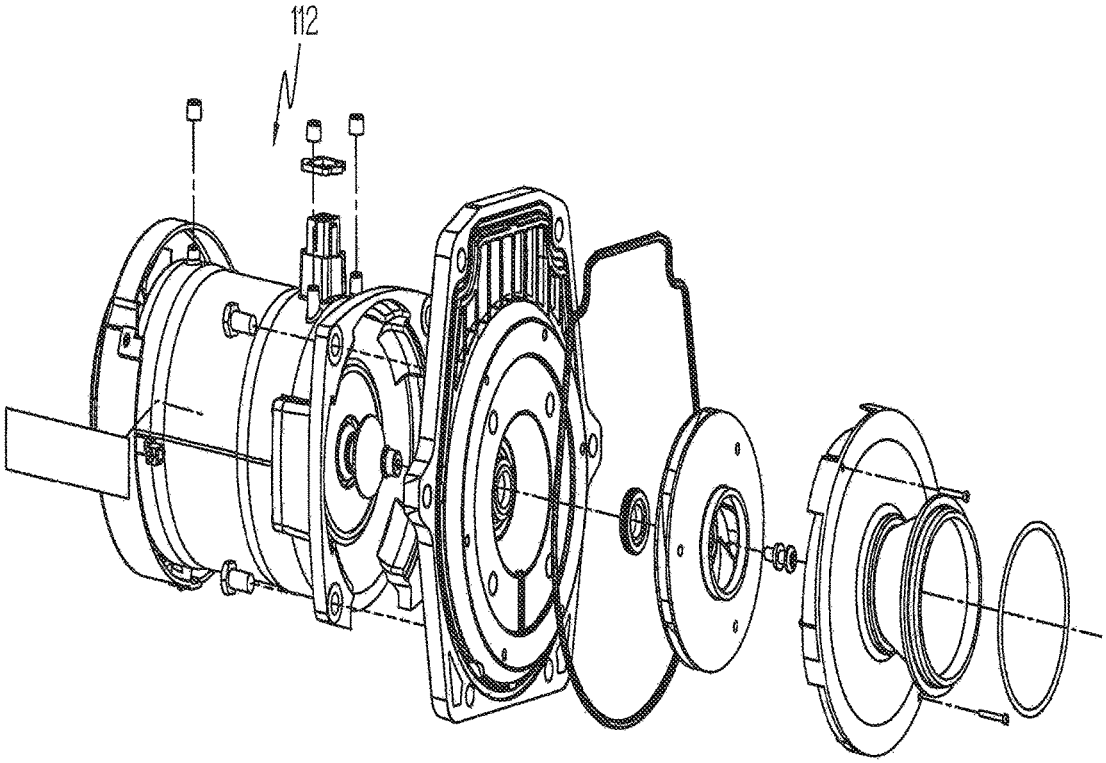
FIG. 5 is a perspective, partially exploded view of a pump of the unit shown in FIG. 4.
Figure 6:
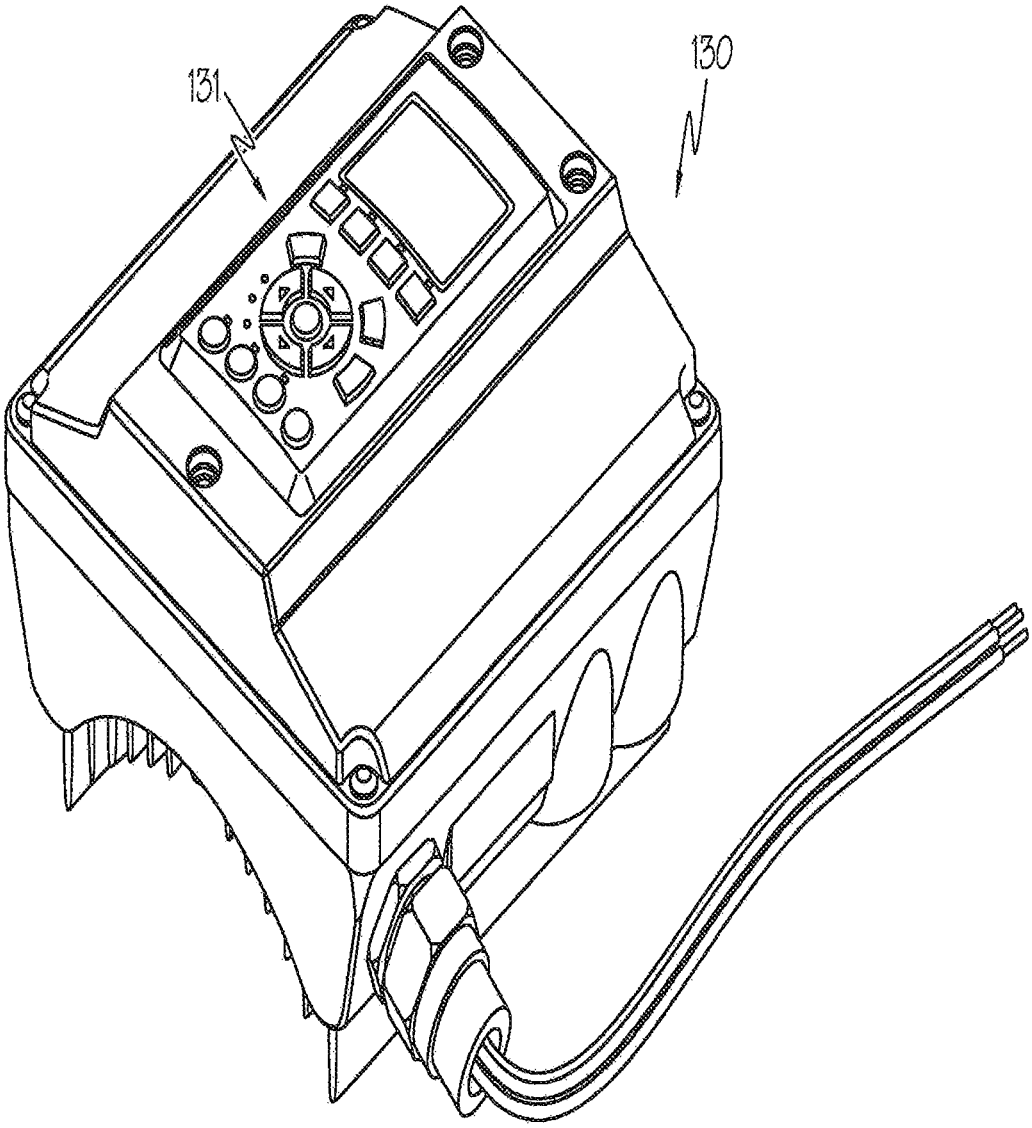
FIG. 6 is a perspective view of a control unit of the pump unit shown in FIG. 4.

Also, it is to be appreciated that the physical appearance of the components of the system 10 or 110) may vary. As some examples of the components, attention is directed to FIGS. 4-6. FIG. 4 is a perspective view of the pump unit 112 and the controller 130 for the system 110 shown in FIG. 2. FIG. 5 is an exploded perspective view of some of the components of the pump unit 112. FIG. 6 is a perspective view of the controller 130 and/or user interface 131.

In addition to the foregoing, a method of controlling the pumping system 10, 110 for moving water of an aquatic application is provided. The pumping system 10, 110 includes the water pump 12, 112 for moving water in connection with performance of an operation upon the water and the variable speed motor 24, 124 operatively connected to drive the pump 12, 112. The method comprises the steps of determining a value indicative of a blockage that inhibits the movement of water through the pumping system 10, 110, and determining a performance value of the pumping system 10, 110. The method further comprises the steps of comparing the performance value to the value indicative of a blockage, and controlling the motor 24, 124 in response to the comparison between the performance value and the value indicative of a blockage. In addition or alternatively, the method can include any of the various elements and/or operations discussed previously herein, and/or even additional elements and/or operations.

It should be evident that this disclosure is by way of example and that various changes may be made by adding, modifying or eliminating details without departing from the scope of the teaching contained in this disclosure. As such, it is to be appreciated that the person of ordinary skill in the art will perceive changes, modifications, and improvements to the example disclosed herein. Such changes, modifications, and improvements are intended to be within the scope of the present invention.

We claim:

1. A method of controlling a pumping system for at least one aquatic application having a pump driven by a motor coupled to the pump, the method comprising:

determining, via a controller in communication with the motor, whether a blockage condition exists based on a power consumption value of the motor, wherein the blockage condition is at least one of an entrapment condition and a deadhead condition, and wherein, if a blockage condition is detected, restarting the pump after detection of the blockage condition, undertaking a detection method in response to the entrapment condition, wherein the controller is alerted upon a first occurrence of a blockage event, or undertaking another detection method in response to the deadhead condition, wherein the controller is alerted upon a plurality of blockage events.

2. The method of claim 1, wherein the power consumption value of the motor is determined using a previous power consumption value at a first time period and a current power consumption value determined at a second time period.

3. The method of claim 2, wherein the previous power consumption value is compared to the current power consumption value to determine a difference value.

4. The method of claim 1, wherein the controller continuously monitors the power consumption value to determine the blockage condition.

5. The method of claim 1, wherein the another detection method alerts the system upon a number of cumulative occurrences indicating the deadhead condition.

6. The method of claim 1, further comprising:

comparing a current power consumption value of the motor to a previously determined power consumption value to determine the entrapment condition; or comparing a deadhead baseline value with a current deadhead value to determine the deadhead condition.

7. A method for controlling a pumping system for at least one aquatic application having a pump coupled to a motor, the method comprising:

determining, via a controller in communication with the motor, whether a blockage condition exists by comparing a current power consumption value of the motor to one of:

a baseline value of power consumption of the motor, or a previous power consumption value of the motor;

performing a condition check to determine whether a speed of the motor has recently changed;

shutting down the pumping system based on the comparison of the current power consumption value if the speed change did not occur during a transition or a stabilization stage of the speed change; and calculating a power gradient baseline value based on the change in speed and corresponding oscillations in power consumption of the motor if the speed has recently changed.

8. The method of claim 7, wherein a difference value is determined based on the comparison of the current power consumption value of the motor to the previous power consumption value of the motor.

9. The method of claim 8, wherein the controller compares the difference value to the power gradient baseline value.

10. The method of claim 8 further comprising shutting down the motor substantially immediately if the difference value indicates a decrease in power consumption of the motor.

11. The method of claim 7, wherein the power gradient baseline value includes a trigger level capable of preventing erroneous triggering of an entrapment condition during speed change transition and setting times.

12. The method of claim 7 further comprising:

calculating a second power gradient baseline value based on a percentage of the current power consumption value of the motor.

13. The method of claim 12 further comprising triggering an entrapment condition if a present change in power consumption of the motor exceeds the percentage of the current power consumption value of the motor.

14. The method of claim 7 further comprising re-starting the pump using an auto-restart mechanism after determining that the speed change did not occur during the transition or stabilization stage of the speed change.

15. A method for controlling a pumping system having a pump that is coupled with a motor, the method comprising:
- establishing, via a controller in communication with the motor, a baseline value of power consumption of the motor during a deadhead condition;
- determining, via the controller, a current value of power consumption of the motor,
- increasing a counter, via the controller, when the current value decreases below the baseline value, and
- determining, via the controller, a deadhead condition caused by a blockage downstream from the pump when the counter exceeds a limit.

16. The method of claim 15, wherein the baseline value of power is dependent on a current speed of the motor.

17. The method of claim 15, wherein the baseline value is a percentage of a no flow power value, the no flow power value representing power consumed during a substantially complete blockage of downstream plumbing.

18. The method of claim 15, wherein the baseline value depends on user inputs related to a sensitivity of the pumping system, the user inputs being provided through a user interface.

19. The method of claim 15, wherein a decrease in power consumption of the motor is indicated by at least one of a relative amount of decrease, a comparison of decreased values, time elapsed since a decrease, and a number of consecutive decreases.

20. The method of claim 15, wherein a decrease in power consumption of the motor is based on a measurement of at least one of current and voltage provided to the motor, or at least one of a power factor, a resistance, and a friction of the motor, or a temperature of water in the aquatic application.

21. The method of claim 15 further comprising:
- monitoring at least one of:
  - a power error determination,
  - a current motor speed compared to at least one of a maximum speed and a minimum speed,
  - a current motor speed compared to a previous motor speed, and
  - a speed change input received from a user interface.

22. The method of claim 15, further comprising:
- monitoring at least one of:
  - a second controller,
  - a manual control system, and
  - a separate program running within the second controller providing at least one of:
    - a motor speed,
    - a power consumption value of the motor,
    - a flow rate, and
    - a pressure value.

23. The method of claim 15, wherein if the controller determines a deadhead condition, performing at least one of the following steps:
- stopping the motor,
- varying a speed of the motor,
- displaying a visual indication,
- locking out the motor until a specific action occurs by a user,
- restarting the motor, and
- restarting the motor after a time delay occurs.

24. A method of operating a pumping system for at least one aquatic application having a pump being electrically coupled with a motor, the method comprising:
- comparing, via a controller in electrical communication with the motor, a current power consumption value of the motor to a substantially immediately previous power consumption value of the motor to determine a difference value;
- shutting down the motor, via the controller, substantially immediately if the difference value indicates a sudden decrease in power consumption of the motor occurring during an entrapment condition caused by a blockage on a suction side of the pump;
- performing a condition check, via the controller, to determine whether a speed of the motor has recently changed before shutting down the motor due to torque ripple; and
- calculating a power gradient baseline value, via the controller, based on the change in speed.

25. The method of claim 24, wherein the power gradient baseline value includes a trigger level capable of preventing erroneous triggering of an entrapment condition during speed change transition and setting times, while permitting an entrapment condition in the event of a severe power gradient change.

26. A method of operating a pumping system for at least one aquatic application having a pump that is operatively coupled with a motor, the method comprising:
- comparing, via a controller in communication with the motor, a current power consumption value of the motor to a substantially immediately previous power consumption value of the motor to determine a difference value;
- shutting down the motor, via the controller, substantially immediately if the difference value indicates a sudden decrease in power consumption of the motor during an entrapment condition caused by a blockage on a suction side of the pump; and
- performing a condition check, via the controller, to determine whether a speed of the motor has recently changed before shutting down the motor in order to avoid shutting down the motor due to torque ripple,
- wherein if the speed has not recently changed, the controller calculates a power gradient baseline value based on a percentage of a present power consumption of the motor.

27. The method of claim 26, wherein an entrapment condition is triggered if a present change in power consumption of the motor exceeds the percentage of the present power consumption.

* * * * *